US007737904B2

(12) United States Patent
Rao et al.

(10) Patent No.: US 7,737,904 B2
(45) Date of Patent: Jun. 15, 2010

(54) ANTENNA SYSTEMS FOR MULTIPLE FREQUENCY BANDS

(75) Inventors: Sudhakar K. Rao, Churchville, PA (US); Chris G. Baran, Hamilton, NJ (US); Chih-Chien Hsu, Cherry Hill, NJ (US); Surjit S. Dhillon, Robbinsville, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 190 days.

(21) Appl. No.: 12/137,472

(22) Filed: Jun. 11, 2008

(65) Prior Publication Data

US 2009/0309801 A1 Dec. 17, 2009

(51) Int. Cl.
*H01Q 13/00* (2006.01)

(52) U.S. Cl. ..... 343/786; 343/772; 343/779

(58) Field of Classification Search ..... 343/772, 343/786, 779

See application file for complete search history.

(56) References Cited

U.S. PATENT DOCUMENTS

| | | | | | |
|---|---|---|---|---|---|
| 3,662,393 | A | | 5/1972 | Cohn | |
| 4,228,410 | A | * | 10/1980 | Goudey et al. | 333/122 |
| 4,258,366 | A | * | 3/1981 | Frosch et al. | 343/786 |
| 4,792,814 | A | | 12/1988 | Ebisui | |
| 5,117,240 | A | | 5/1992 | Anderson et al. | |
| 5,166,698 | A | | 11/1992 | Ashbaugh et al. | |
| 5,617,108 | A | * | 4/1997 | Silinsky et al. | 343/786 |
| 5,706,017 | A | | 1/1998 | Büttgenbach | |
| 5,793,334 | A | * | 8/1998 | Anderson et al. | 343/786 |
| 5,974,323 | A | | 10/1999 | Doner | |
| 6,075,484 | A | | 6/2000 | Daniel et al. | |
| 6,084,552 | A | | 7/2000 | Robertson et al. | |
| 6,108,561 | A | | 8/2000 | Mallinckrodt | |
| 6,222,503 | B1 | | 4/2001 | Gietema et al. | |
| 6,240,072 | B1 | | 5/2001 | Lo et al. | |
| 6,336,030 | B2 | | 1/2002 | Houston et al. | |
| 6,366,256 | B1 | | 4/2002 | Ramanujam et al. | |
| 6,377,561 | B1 | | 4/2002 | Black et al. | |

(Continued)

OTHER PUBLICATIONS

Sudhaker K. Rao, "Parametric Design and Analysis of Multiple-Beam Reflector Antennas for Satellite Communications," Aug. 2003, pp. 26-34, vol. 45, No. 4, IEEE Antennas and Propagation Magazine.

*Primary Examiner*—Douglas W Owens
*Assistant Examiner*—Dieu Hien T Duong
(74) *Attorney, Agent, or Firm*—McDermott Will & Emery LLP

(57) ABSTRACT

An antenna system for transmitting and/or receiving radio frequency (RF) signals in multiple frequency bands includes a horn antenna and a feed network. The horn antenna may transmit and/or receive RF signals in multiple frequency bands that are spread over more than an octave bandwidth with at least a 2.44-to-1 bandwidth ratio. The horn antenna includes a throat, an aperture, and an interior surface. The feed network includes a first waveguide section, a first junction, one or more first filters, and a first step-down waveguide section. The first waveguide section can provide a matching network and transmit and/or receive the RF signals in the multiple frequency bands. The first junction can transmit and/or receive the RF signals in first selected band(s) of the multiple frequency bands. The first step-down waveguide section may transmit and/or receive the RF signals in second selected band(s) of the multiple frequency bands.

21 Claims, 26 Drawing Sheets

U.S. PATENT DOCUMENTS

| | | | |
|---|---|---|---|
| 6,384,795 | B1 | 5/2002 | Bhattacharyya et al. |
| 6,396,453 | B2 | 5/2002 | Amyotte et al. |
| 6,441,795 | B1 | 8/2002 | Volman |
| 6,522,306 | B1 | 2/2003 | Parrikar et al. |
| 6,642,900 | B2 | 11/2003 | Bhattacharyya et al. |
| 7,183,991 | B2 | 2/2007 | Bhattacharyya et al. |
| 2002/0000945 | A1 | 1/2002 | Amyotte et al. |
| 2003/0034422 | A1 | 2/2003 | Higgins |
| 2004/0036661 | A1 | 2/2004 | Hanlin et al. |
| 2005/0245265 | A1 | 11/2005 | Nascimbene et al. |
| 2007/0225002 | A1 | 9/2007 | Keller et al. |

* cited by examiner

1030

| | D (in.) | L (in.) |
|---|---|---|
| 1 | 0.640 | 0.000 |
| 2 | 0.640 | 0.200 |
| 3 | 0.646 | 0.506 |
| 4 | 0.877 | 1.175 |
| 5 | 1.299 | 2.718 |
| 6 | 1.560 | 5.918 |
| 7 | 2.100 | 7.901 |

| Frequency (GHz) | Return Loss (dB) | X-pol (20°) (dB) | Efficiency (%) |
|---|---|---|---|
| 12.5 | -26.5 | -22.3 | 82 |
| 17.3 | -48.0 | -22.5 | 80 |
| 17.8 | -50.2 | -23.6 | 80 |
| 18.4 | -43.6 | -23.6 | 79 |
| 20.2 | -41.7 | -22.1 | 76 |
| 24.8 | -50.1 | -23.0 | 76 |
| 25.3 | -44.3 | -23.7 | 76 |
| 28.5 | -44.0 | -23.9 | 75 |
| 30.0 | -45.2 | -22.1 | 74 |

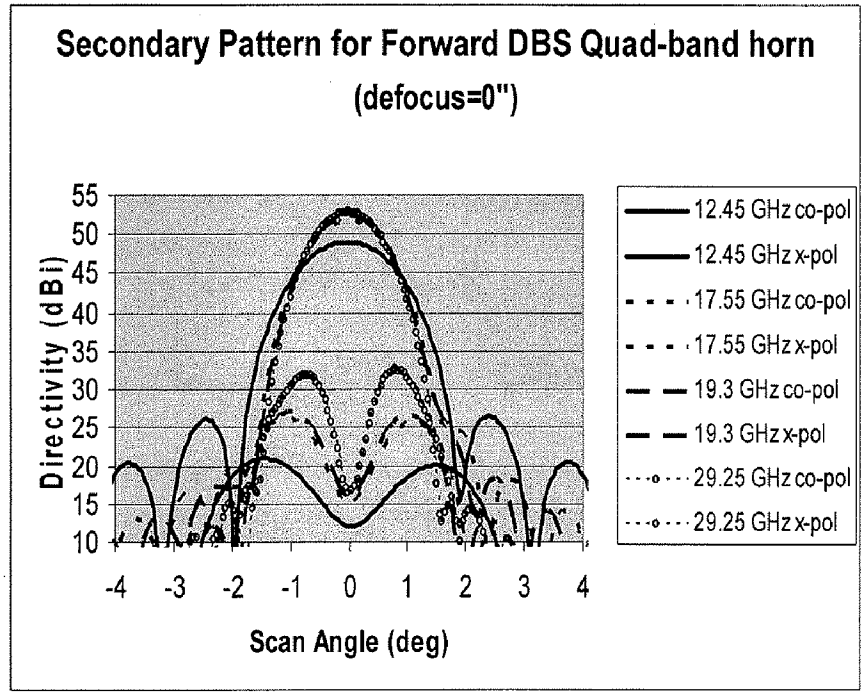
FIG. 13 A
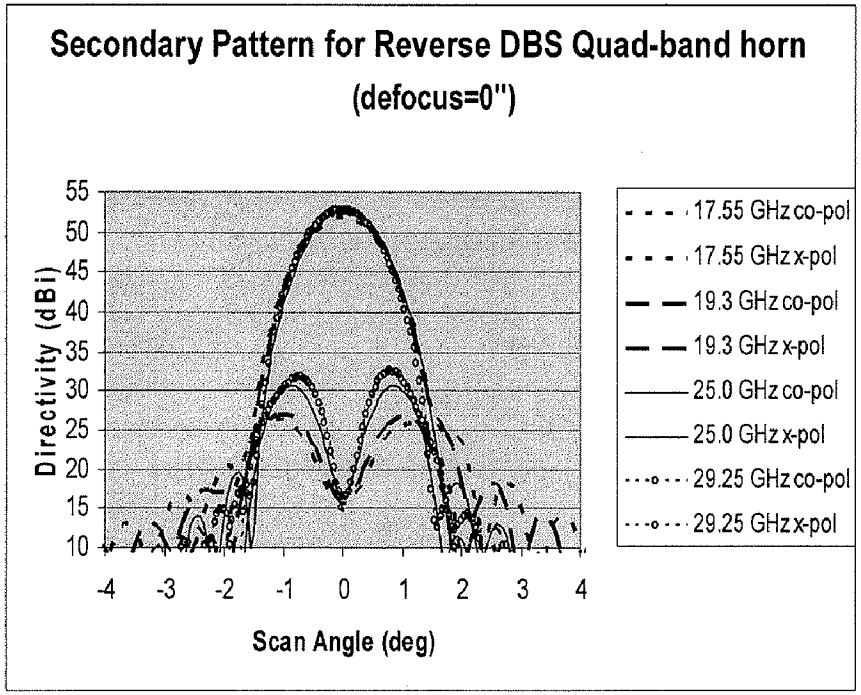
FIG. 13 B
EOC Directivity
| Freq | Coverage | Peak | Co-pol | C/X |
|---|---|---|---|---|
| 12.45 | ±0.5° | 49.0 | 47.5 | 32.4 |
| 17.55 | ±0.5° | 51.8 | 49.4 | 28.3 |
| 19.30 | ±0.5° | 52.4 | 49.7 | 27.0 |
| 25.00 | ±0.5° | 53.0 | 50.0 | 22.8 |
| 29.25 | ±0.5° | 52.8 | 50.0 | 19.7 |
FIG. 13 C

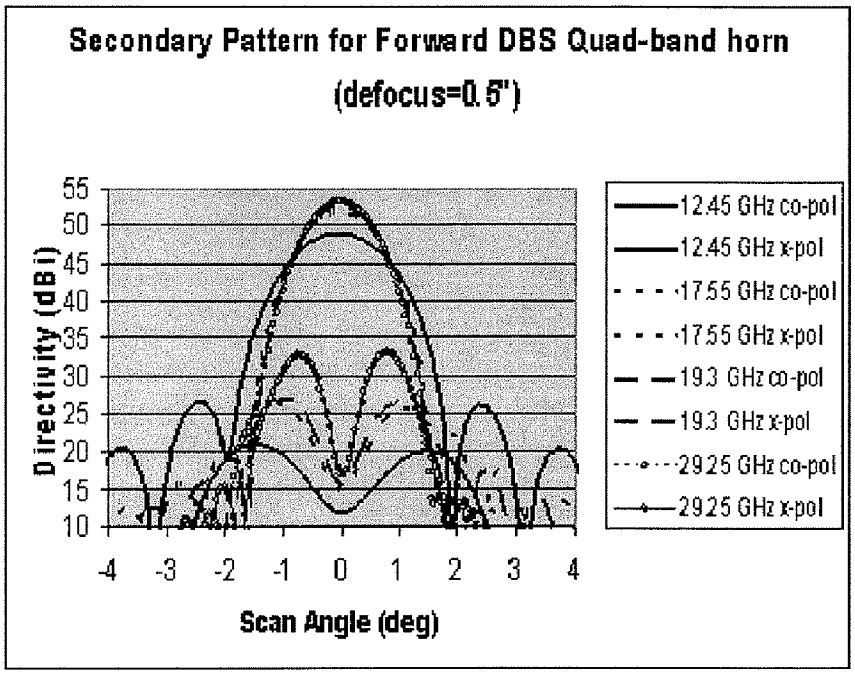
FIG. 14 A
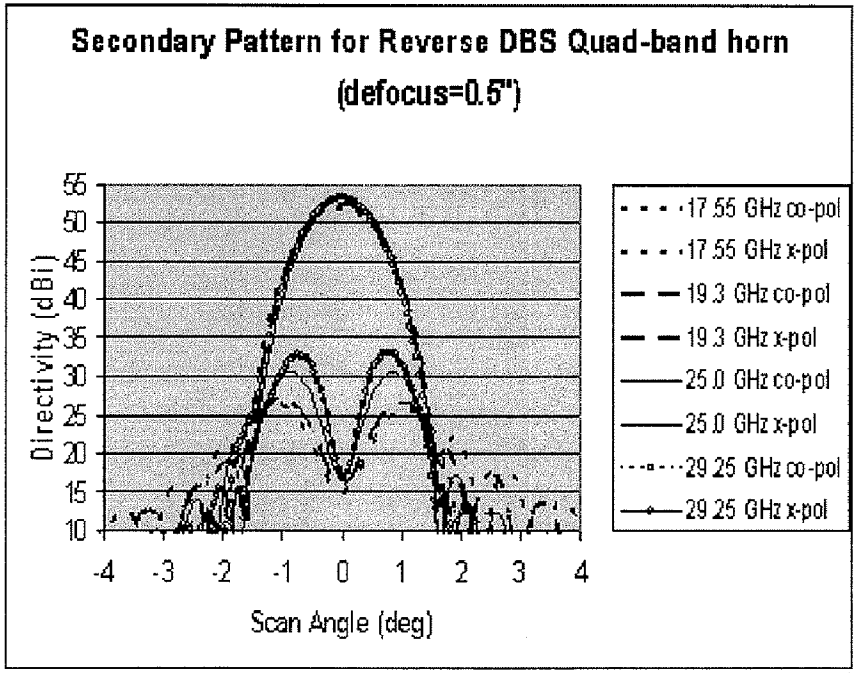
FIG. 14 B
EOC Directivity
| Freq | Coverage | Peak | Co-pol | C/X |
|---|---|---|---|---|
| 12.45 | ±0.5° | 49.0 | 47.5 | 32.6 |
| 17.55 | ±0.5° | 51.9 | 49.5 | 28.7 |
| 19.30 | ±0.5° | 52.5 | 49.8 | 27.3 |
| 25.00 | ±0.5° | 53.3 | 50.0 | 23.0 |
| 29.25 | ±0.5° | 53.3 | 50.0 | 19.1 |
FIG. 14 C

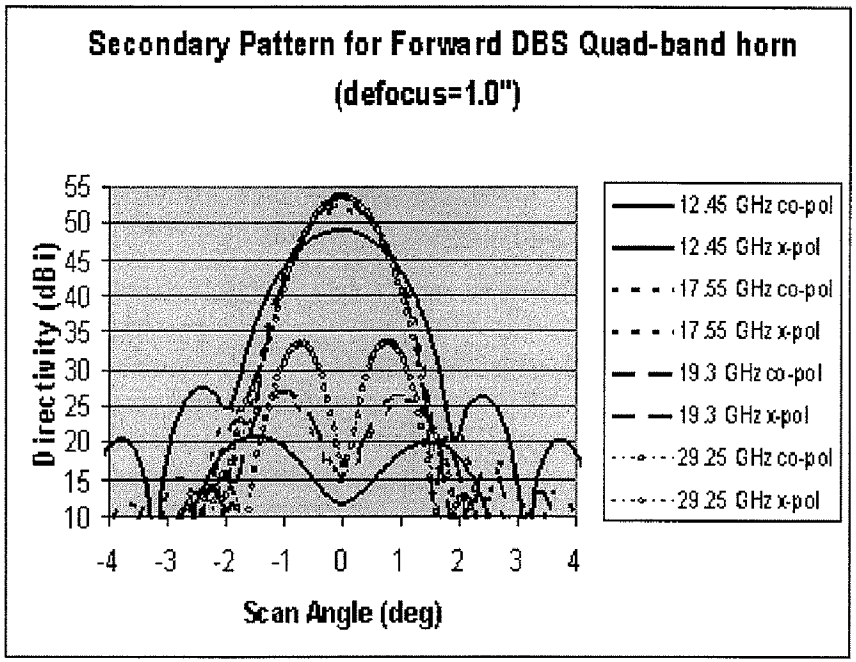
FIG. 15 A
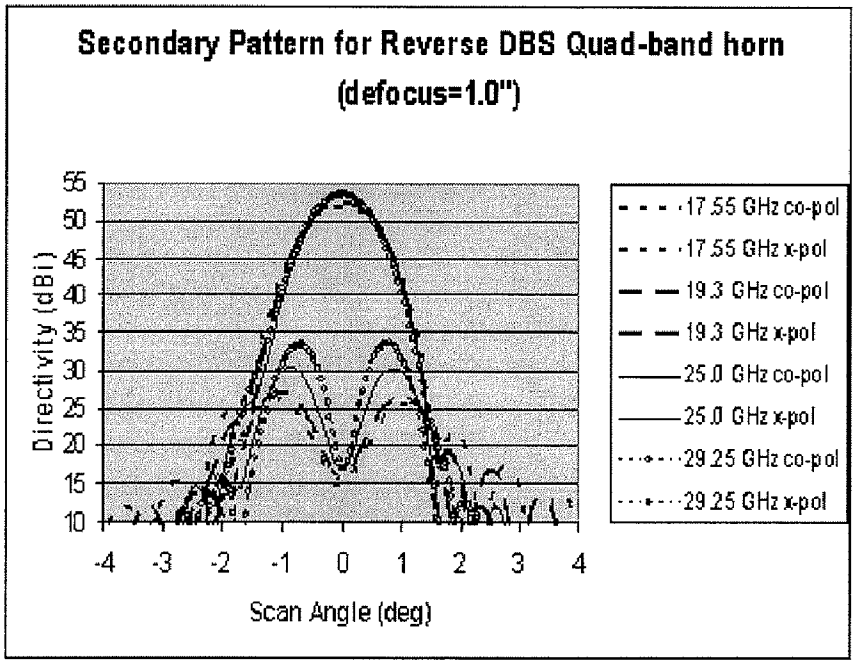
FIG. 15 B
EOC Directivity
| Freq | Coverage | Peak | Co-pol | C/X |
|---|---|---|---|---|
| 12.45 | ±0.5° | 49.0 | 47.4 | 32.8 |
| 17.55 | ±0.5° | 51.9 | 49.5 | 28.7 |
| 19.30 | ±0.5° | 52.6 | 49.8 | 27.4 |
| 25.00 | ±0.5° | 53.5 | 50.1 | 23.3 |
| 29.25 | ±0.5° | 53.6 | 50.0 | 18.4 |
FIG. 15 C

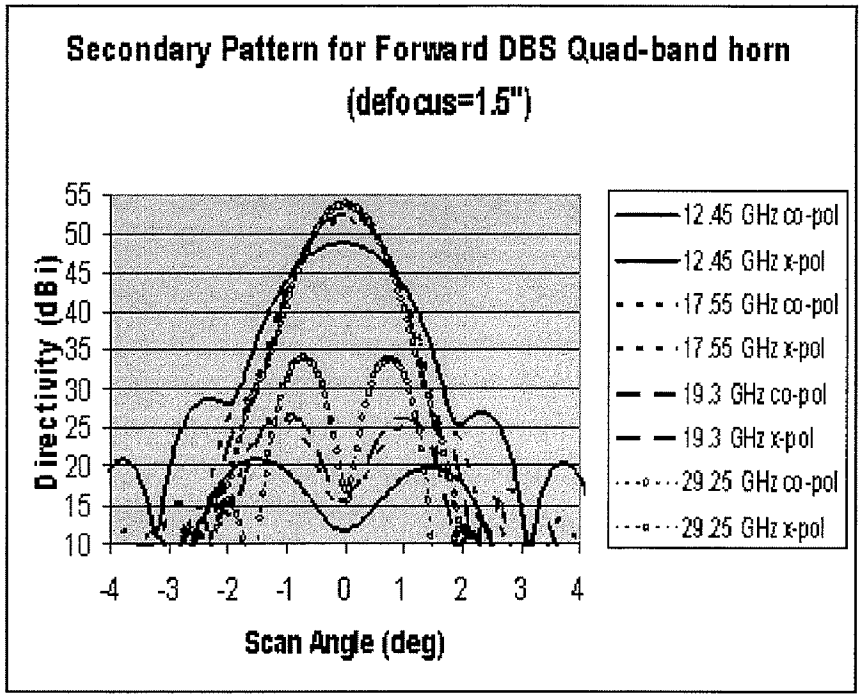
FIG. 16 A
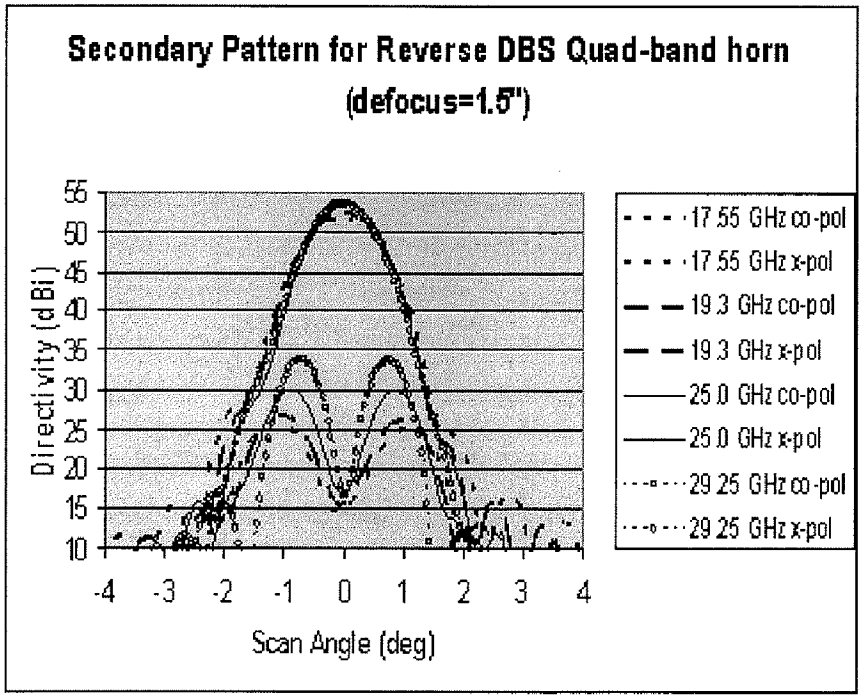
FIG. 16 B
EOC Directivity
| Freq | Coverage | Peak | Co-pol | C/X |
|---|---|---|---|---|
| 12.45 | ±0.5° | 48.9 | 47.3 | 32.6 |
| 17.55 | ±0.5° | 51.8 | 49.4 | 28.7 |
| 19.30 | ±0.5° | 52.5 | 49.7 | 27.4 |
| 25.00 | ±0.5° | 53.6 | 50.1 | 23.7 |
| 29.25 | ±0.5° | 53.7 | 50.0 | 18.1 |
FIG. 16 C

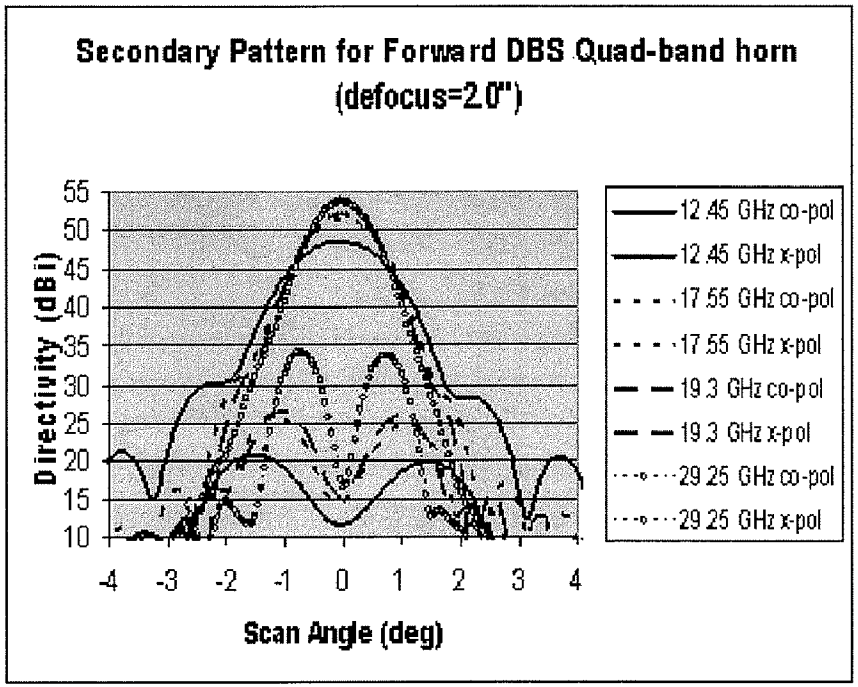
FIG. 17 A
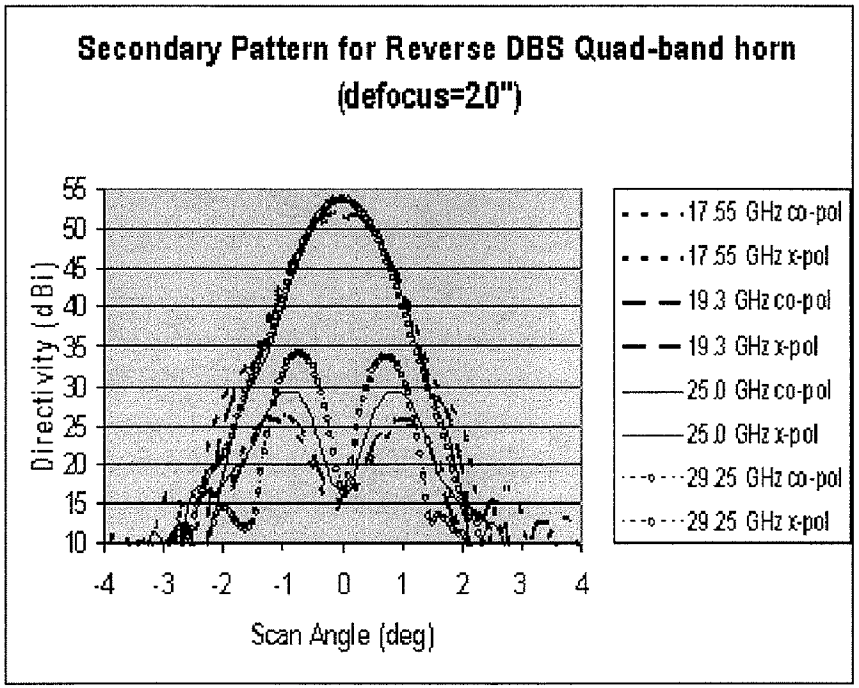
FIG. 17 B
EOC Directivity
| Freq | Coverage | Peak | Co-pol | C/X |
|---|---|---|---|---|
| 12.45 | ±0.5° | 48.7 | 47.1 | 32.5 |
| 17.55 | ±0.5° | 51.6 | 49.2 | 28.8 |
| 19.30 | ±0.5° | 52.3 | 49.6 | 27.5 |
| 25.00 | ±0.5° | 53.5 | 50.1 | 24.1 |
| 29.25 | ±0.5° | 53.7 | 49.9 | 18.0 |
FIG. 17 C

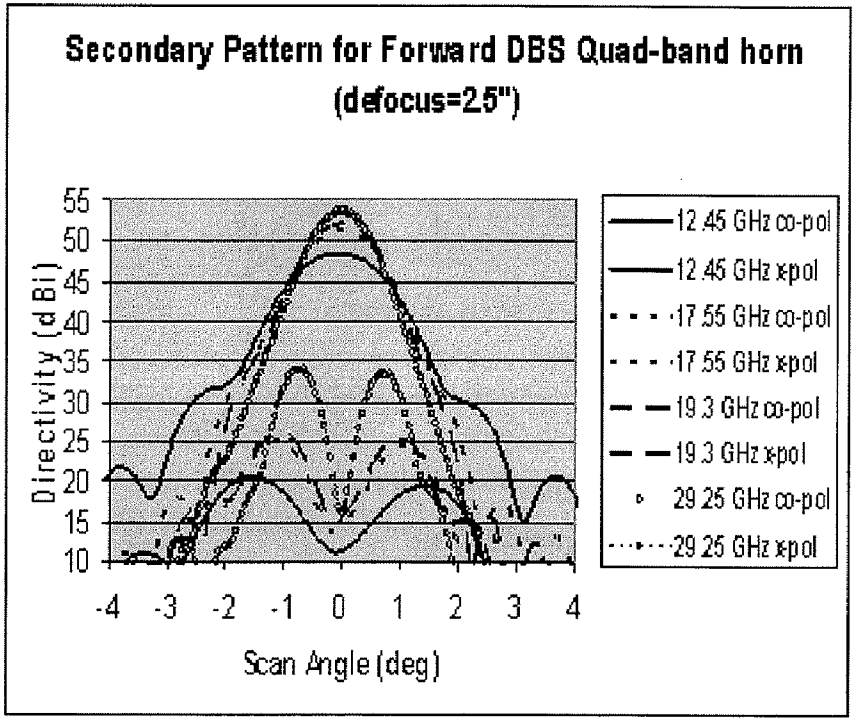
FIG. 18 A
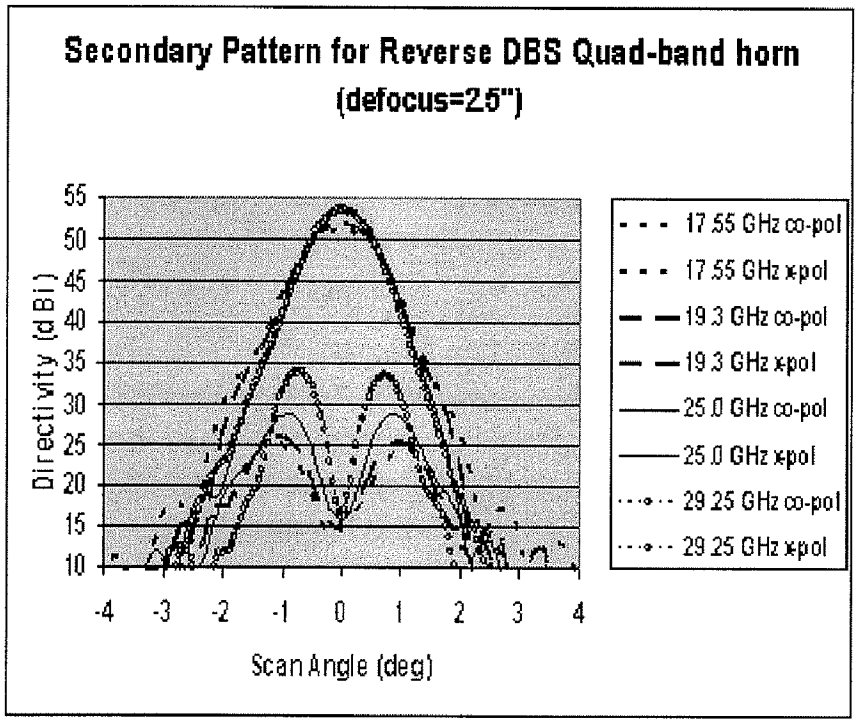
FIG. 18 B
EOC Directivity
| Freq | Coverage | Peak | Co-pol | C/X |
|---|---|---|---|---|
| 12.45 | ±0.5° | 48.5 | 46.9 | 32.3 |
| 17.55 | ±0.5° | 51.3 | 48.9 | 28.9 |
| 19.30 | ±0.5° | 52.0 | 49.3 | 27.6 |
| 25.00 | ±0.5° | 53.3 | 49.9 | 24.7 |
| 29.25 | ±0.5° | 53.6 | 49.8 | 18.2 |
FIG. 18 C

Forward DBS

| Freq (GHz) | EOC (dBi) | C/X (dB) |
|---|---|---|
| 12.45 | 46.0 | 29.9 |
| 17.55 | 47.0 | 24.3 |
| 19.30 | 47.0 | 23.3 |
| 29.25 | 46.2 | 15.2 |

FIG. 26 A

Reverse DBS

| Freq (GHz) | EOC (dBi) | C/X (dB) |
|---|---|---|
| 17.55 | 47.0 | 24.3 |
| 25.00 | 46.6 | 18.9 |
| 19.30 | 47.0 | 23.3 |
| 29.25 | 46.2 | 15.2 |

FIG. 26 B

ANTENNA SYSTEMS FOR MULTIPLE FREQUENCY BANDS

STATEMENT AS TO RIGHTS TO INVENTIONS MADE UNDER FEDERALLY SPONSORED RESEARCH OR DEVELOPMENT

Not applicable.

FIELD

The present invention generally relates to antenna systems and, in particular, relates to antenna systems for multiple frequency bands.

BACKGROUND

The current technology for commercial satellites is capable of providing either local-channel direct broadcast satellite (DBS) services at 12/17 GHz bands or Ka-band broadband satellite services at 20/30 GHz bands. This is mainly due to bandwidth limitations of antenna systems that could provide efficient radiation over a bandwidth ratio of about 1.64 (ratio of the highest frequency to lowest frequency, e.g., 30/18.3=1.64) or less. Thus, it has been difficult to produce very wideband antennas, with bandwidth ratios beyond 1.64, using conventional techniques. Two separate sets of antennas can be carried out to overcome the above problem, but the two sets of antennas (one for DBS and the other for broadband) can not be accommodated on the spacecraft due to the reason that each set of antennas requires the use of four large reflector antennas (about 100 inch in aperture each) and the required eight large reflector antennas can not be accommodated on the spacecraft. Because of these bandwidth and aperture limitations of the antennas, operators like DirecTV had to launch two separate satellites, one supporting local-channel DBS services (e.g., DTV-4S, DTV-10, DTV-11, Echo 10) and the other for Ka-band broadband satellite services (e.g., SpaceWay, Anik-F2, EutelSat-Ka, Viasat).

SUMMARY

In accordance with an exemplary embodiment of the present invention, a novel quad-band antenna provides efficient radiation patterns over more than an octave bandwidth with a bandwidth ratio of more than 2.44. Such a quad-band antenna can support both forward DBS (12/17 GHz bands) and the Ka-band broadband satellite services using a single set of antennas (e.g., a single set of four reflector antennas). In another embodiment, it can support the recent reverse DBS (17/25 GHz bands) and the Ka-band broadband satellite services using one set of antennas (e.g., one set of four reflector antennas).

In one aspect of the present invention, an antenna system is disclosed for transmitting and/or receiving radio frequency signals in multiple frequency bands. The antenna system comprises a horn antenna and a feed network. The horn antenna is configured to transmit and/or receive radio frequency signals in multiple frequency bands that are spread over more than an octave bandwidth with at least a 2.44-to-1 bandwidth ratio. The horn antenna comprises a throat, an aperture, and an interior surface. The throat is disposed at a first end of the horn antenna. The aperture is disposed distantly from the throat at a second end of the horn antenna. The interior surface is disposed in the horn antenna between the first end and the second end of the horn antenna. The interior surface comprises a plurality of slope discontinuities.

The feed network is coupled to the horn antenna. The feed network comprises a first waveguide section, a first junction, one or more first filters, and a first step-down waveguide section. The first waveguide section is configured to provide a matching network. The first waveguide section is also configured to transmit and/or receive the radio frequency signals in the multiple frequency bands. The first junction is configured to transmit and/or receive the radio frequency signals in first selected one or more frequency bands of the multiple frequency bands and not all of the multiple frequency bands. The one or more first filters is configured to pass the radio frequency signals in the first selected one or more frequency bands of the multiple frequency bands and configured to reject the radio frequency signals in frequency bands not in the first selected one or more frequency bands of the multiple frequency bands.

The first step-down waveguide section is coupled to the first waveguide section. The first step-down waveguide section is also configured to transmit and/or receive the radio frequency signals in second selected one or more frequency bands of the multiple frequency bands and configured to reject the radio frequency signals in the first selected one or more frequency bands of the multiple frequency bands.

In another aspect of the present invention, an antenna system is disclosed for transmitting and/or receiving radio frequency signals in multiple frequency bands. The antenna system comprises a horn antenna and a feed network. The horn antenna is configured to transmit and/or receive radio frequency signals in multiple frequency bands. The horn antenna comprises a throat, an aperture, and an interior surface. The throat is disposed at a first end of the horn antenna. The aperture is disposed distantly from the throat at a second end of the horn antenna. The interior surface is disposed in the horn antenna between the first end and the second end of the horn antenna.

The interior surface comprises a plurality of slope discontinuities. The interior surface increases in diameter from the first end of the horn antenna to the second end of the horn antenna. The interior surface has the smallest diameter at the throat. The interior surface has the largest diameter at the aperture. The diameter of the interior surface at the aperture is less than 12 times the wavelength of the highest frequency of the multiple frequency bands, and the diameter of the interior surface at the aperture is greater than 1.7 times the wavelength of the lowest frequency of the multiple frequency bands.

The feed network is coupled to the horn antenna. The feed network comprises a first waveguide section, a first junction, one or more first filters, and a first step-down waveguide section. The first waveguide section is configured to provide a matching network. The first waveguide section is configured to transmit and/or receive the radio frequency signals in the multiple frequency bands. The first junction is configured to transmit and/or receive the radio frequency signals in first selected one or more frequency bands of the multiple frequency bands and not all of the multiple frequency bands.

The one or more first filters is configured to pass the radio frequency signals in the first selected one or more frequency bands of the multiple frequency bands and is configured to reject the radio frequency signals in frequency bands not within the first selected one or more frequency bands of the multiple frequency bands. The first step-down waveguide section is configured to transmit and/or receive the radio frequency signals in second selected one or more frequency bands of the multiple frequency bands and not in the first selected one or more frequency bands of the multiple frequency bands.

In the following description, reference is made to the accompanying attachment that forms a part thereof, and in which are shown by way of illustration specific embodiments in which the invention may be practiced. It is to be understood that other embodiments may be utilized and changes may be made without departing from the scope of the present invention.

BRIEF DESCRIPTION OF DRAWINGS

The invention both to its organization and manner of operation, may be further understood by reference to the drawings that include FIGS. 1 through 26B, taken in connection with the following descriptions:

FIG. 13A is an exemplary graph of a secondary radiation pattern of a reflector antenna for forward DBS taken with a defocus of zero inches in accordance with an exemplary embodiment of the present invention;

FIG. 13B is an exemplary graph of a secondary radiation pattern of a reflector antenna for reverse DBS taken with a defocus of zero inches in accordance with an exemplary embodiment of the present invention;

FIG. 13C illustrates an exemplary edge of coverage directivity values of the antenna with zero defocus for forward DBS, reverse DBS, and broadband frequencies;

FIG. 14A is an exemplary graph of a secondary radiation pattern of a reflector antenna for forward DBS taken with a defocus of 0.5 inches in accordance with an exemplary embodiment of the present invention;

FIG. 14B is an exemplary graph of a secondary radiation pattern of a reflector antenna for reverse DBS taken with a defocus of 0.5 inches in accordance with an exemplary embodiment of the present invention;

FIG. 14C illustrates an exemplary edge of coverage directivity of the antenna with 0.5 inches defocus for forward DBS, reverse DBS, and broadband frequencies;

FIG. 15A is an exemplary graph of a secondary radiation pattern of a reflector antenna for forward DBS taken with a defocus of 1.0 inch in accordance with an exemplary embodiment of the present invention;

FIG. 15B is an exemplary graph of a secondary radiation pattern of a reflector antenna for reverse DBS taken with a defocus of 1.0 inch in accordance with an exemplary embodiment of the present invention;

FIG. 15C illustrates an exemplary edge of coverage directivity of the antenna with 1.0 inches defocus for forward DBS, reverse DBS, and broadband frequencies;

FIG. 16A is an exemplary graph of a secondary radiation pattern of a reflector antenna for forward DBS taken with a defocus of 1.5 inches in accordance with an exemplary embodiment of the present invention;

FIG. 16B is an exemplary graph of a secondary radiation pattern of a reflector antenna for reverse DBS taken with a defocus of 1.5 inches in accordance with an exemplary embodiment of the present invention;

FIG. 16C illustrates an exemplary edge of coverage directivity of the antenna with 1.5 inches defocus for forward DBS, reverse DBS, and broadband frequencies;

FIG. 17A is an exemplary graph of a secondary radiation pattern of a reflector antenna for forward DBS taken with a defocus of 2.0 inches in accordance with an exemplary embodiment of the present invention;

FIG. 17B is an exemplary graph of a secondary radiation pattern of a reflector antenna for reverse DBS taken with a defocus of 2.0 inches in accordance with an exemplary embodiment of the present invention;

FIG. 17C illustrates an exemplary edge of coverage directivity of the antenna with 2.0 inches defocus for forward DBS, reverse DBS, and broadband frequencies;

FIG. 18A is an exemplary graph of a secondary radiation pattern of a reflector antenna for forward DBS taken with a defocus of 2.5 inches in accordance with an exemplary embodiment of the present invention;

FIG. 18B is an exemplary graph of a secondary radiation pattern of a reflector antenna for reverse DBS taken with a defocus of 2.5 inches in accordance with an exemplary embodiment of the present invention;

FIG. 18C illustrates an exemplary edge of coverage directivity of the antenna with 2.5 inches defocus for forward DBS, reverse DBS, and broadband frequencies;

FIG. 26A illustrates an exemplary performance summary of a multi-band antenna system for forward DBS in accordance with exemplary embodiments of the present invention; and FIG. 26B illustrates an exemplary performance summary of a multi-band antenna system for reverse DBS in accordance with exemplary embodiments of the present invention.

DETAILED DESCRIPTION

Figure 1:
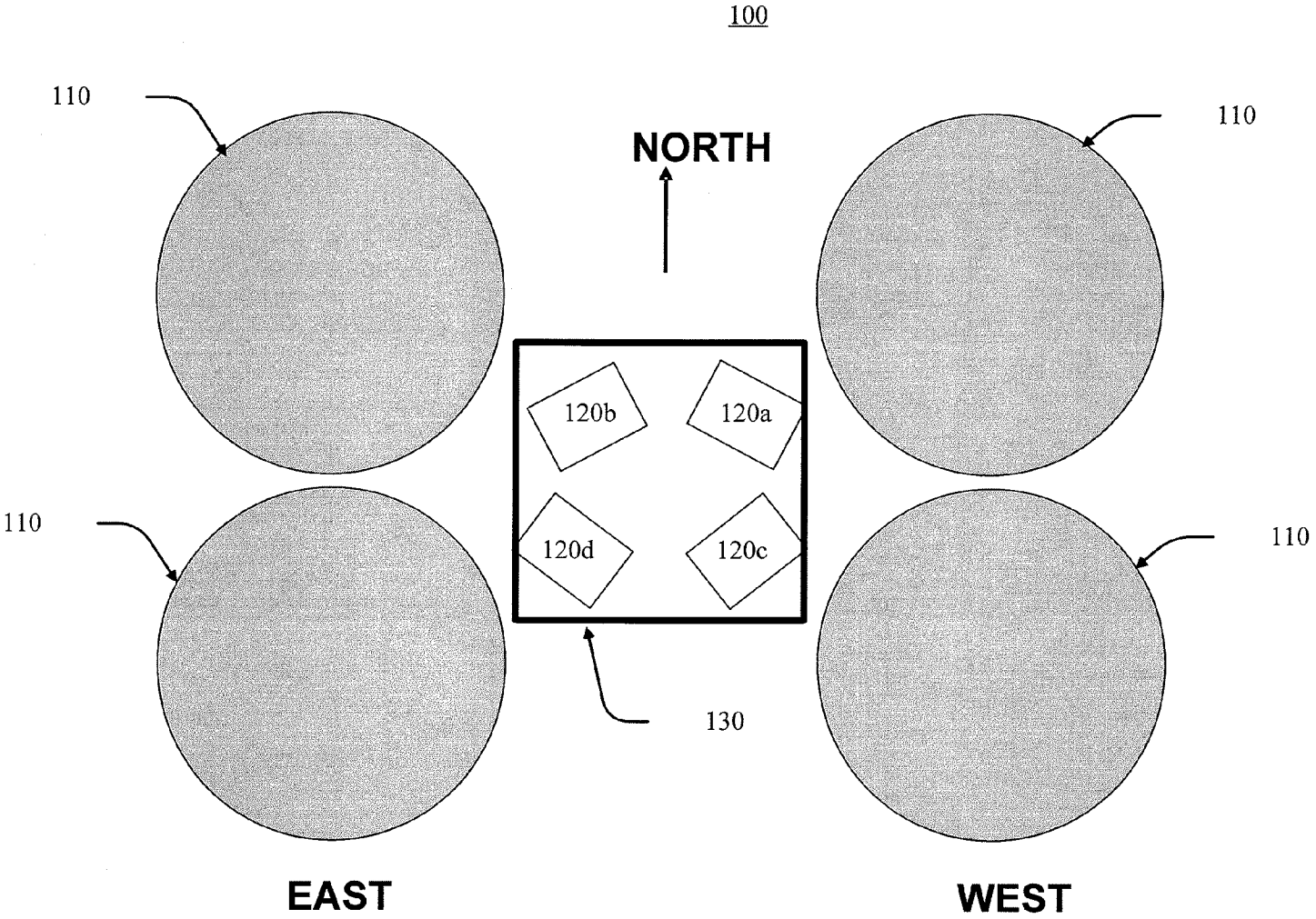
FIG. 1 illustrates an exemplary multiple-beam antenna system.

The following description of illustrative non-limiting embodiments of the invention discloses specific configurations and components. However, the embodiments are merely examples of the present invention, and thus, the specific features described below are merely used to describe such embodiments to provide an overall understanding of the present invention. One skilled in the art readily recognizes that the present invention is not limited to the specific embodiments described below. Furthermore, certain descriptions of various configurations and components of the present invention that are known to one skilled in the art are omitted for the sake of clarity and brevity. Further, while the term "embodiment" may be used to describe certain aspects of the invention, the term "embodiment" should not be construed to mean that those aspects discussed apply merely to that embodiment, but that all aspects or some aspects of the disclosed invention may apply to all embodiments, or some embodiments. Like components are labeled with identical element numbers for ease of understanding.

In accordance with various exemplary embodiments, the subject technology can overcome the bandwidth and spacecraft accommodation limitations of the current antenna systems. Utilizing multi-band antennas, such as the disclosed "quad-band" antennas, allows for minimal asset allocation on the space segment with improved system cost as well as potential use for common user terminal equipment on the ground. Common ground terminal supporting multiple satellite services reduces the ground segment cost significantly which is often subsidized by the satellite operators as an enticement to consumers to subscribe the services. This common ground terminal would allow for one installation and alignment to a single spacecraft minimizing the installation costs. These could be employed for direct broadcast satellite (DBS) and Ka-band broadband satellite services allowing for two of the three legs of the traditional telecom "triple play" or utilizing voice-over-Internet-protocol (VoIP), allowing for all three legs of the "triple play." This capability could be utilized for combined standards DBS, or reverse DBS, and Ka-band broadband allowing for use of common antenna assets supporting all of the three services both on the spacecraft and on the ground. An extension of this technology may also be applicable to mobile user terminals for both commercial and government applications.

In one exemplary embodiment, a novel multi-band horn antenna (e.g., a quad-band horn antenna) can support the four distinct frequency bands required to support the local-channel DBS and the broadband satellite services over a bandwidth ratio of 2.44. A multi-band horn antenna of the subject technology can minimize the number of reflectors (e.g., four reflectors instead of eight). This allows an antennas system to stow the deployed reflectors within a 4-meter launch-fairing envelope. The four discrete frequency bands are: (1) 12.2 to 12.7 GHz ("12 GHz frequency band") for forward DBS downlink, (2) 17.3 to 17.8 GHz ("17 GHz frequency band") for forward DBS uplink, (3) 18.3 to 20.2 GHz ("20 GHz frequency band") for broadband downlink, and (4) 28.1 to 30.0 GHz ("30 GHz frequency band") for broadband uplink. For reverse DBS services, the four discrete frequency bands are: (1) 17.3 to 17.8 GHz ("17 GHz frequency band") for reverse DBS downlink, (2) 24.75 to 25.25 GHz ("25 GHz frequency band") for reverse DBS uplink, (3) 18.3 to 20.2 GHz ("20 GHz frequency band") for broadband downlink, and (4) 28.1 to 30.0 GHz ("30 GHz frequency band") for broadband uplink.

In the example provided above, the frequency bands are discrete (e.g., distinct) in that each frequency band has its own frequency range, and one frequency band is typically separated from the next frequency band. In other words, a gap may exist between one frequency band and the next frequency band so that the frequency bands are not continuous from one band to the next. It should be noted that the invention is not limited to the exemplary frequency bands described above, and the invention may be utilized for other frequency bands and any number of frequency bands (e.g., two or more).

According to one aspect of the invention, the extreme bandwidth ratio requirement of 2.44 (30 GHz/12.2 GHz) can be met by using a multi-band (e.g., quad-band) smooth-walled multi-mode horn antenna that realizes the high efficiency values required to achieve desired radiation patterns at each of the multiple frequency bands. A feed assembly may be realized using two symmetrical ortho-mode transducer (OMT) junctions (or simply referred later as symmetrical junctions), two diplexers, a number of band-reject filters, and a polarizer resulting in an 8-port feed network that carries all of the multiple discrete frequency bands with proper isolation among the frequency bands and with low axial ratio.

A quad-band horn antenna utilizing the subject technology has achieved high efficiency values of the order 74% to 82% over more than an octave band. A number of feed assemblies have been employed to illuminate each of the reflectors in order to provide about 40 spot beams that carry the DBS (forward or reverse bands) and broadband signals for direct-to-home broadcast of local TV channels as well as Ka-band broadband signals for internet and data applications. While three or four reflectors have been utilized in exemplary embodiments, the invention is not limited to these numbers, and any number of reflectors may be used. The feed array is de-focused from the focal-plane of the reflector in order to optimize the radiation patterns over all the multiple frequency bands. The computed spot beam patterns show that efficient radiation is achieved over all the five frequency bands (including reverse DBS band). This allows the same antenna to be used for forward DBS plus broadband services or reverse DBS plus broadband service applications.

FIG. 1 illustrates an exemplary multiple-beam antenna system 100 including multiple reflectors 110 (e.g., single offset reflectors) mounted on a spacecraft body 130. While four reflectors are shown in this example, any number of reflectors may be utilized. Each of the reflectors 110 may be illuminated with a cluster of feed assemblies 120*a* (e.g., NW cluster), 120*b* (e.g., NE cluster), 120*c* (e.g., SW cluster), 120*d* (e.g., SE cluster). Each cluster may include, for example, 10-20 feed assemblies. According to one exemplary embodiment, each feed assembly may include a horn antenna, a feed network, and a repeater. As the reflectors 110 provide signal communication over transmission or reception frequency bands, the feed assemblies associated with the respective reflectors support transmission or reception over all the selected frequency bands.

Figure 2:
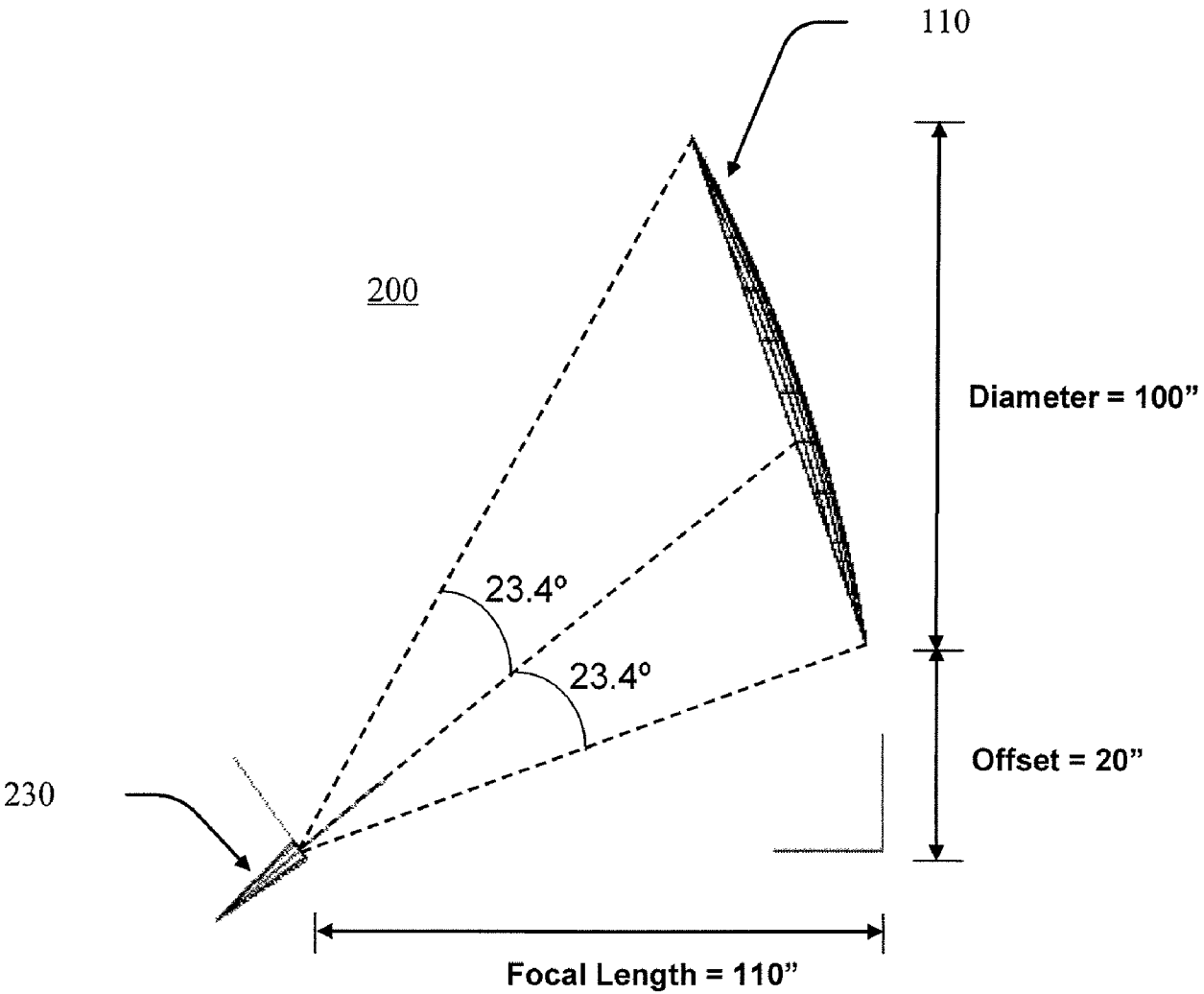
FIG. 2 illustrates an exemplary reflector antenna system according to an exemplary embodiment of the present invention.

FIG. 2 illustrates an antenna system 200 according to an exemplary embodiment of the present invention. The antenna system 200 includes a reflector 110 (which is sometimes referred to as a reflector antenna) and a horn antenna 230. The horn antenna 230 may be mounted on the spacecraft deck and the reflector 110 may be deployed on-orbit from its stowed position during launch using a deployment boom and associated mechanisms (not illustrated). A horn antenna 230 may be an array of horn antennas, and may be disposed along an axis extending generally along a radio frequency focal point in relation to reflector 110. A horn antenna 230 may be configured to transmit and/or receive radio frequency signals by reflecting radio frequency signals off of a reflector 110. In this example, a reflector 110 has a diameter of about 100 inches and is offset by about 20 inches. The focal length is about 110 inches, and the focal length to diameter ratio is 1.1. The reflector illumination angle is +/−23.4° relative to the axis joining the focal point and the center of the reflector aperture and is illustrated in FIG. 2.

Figure 3:
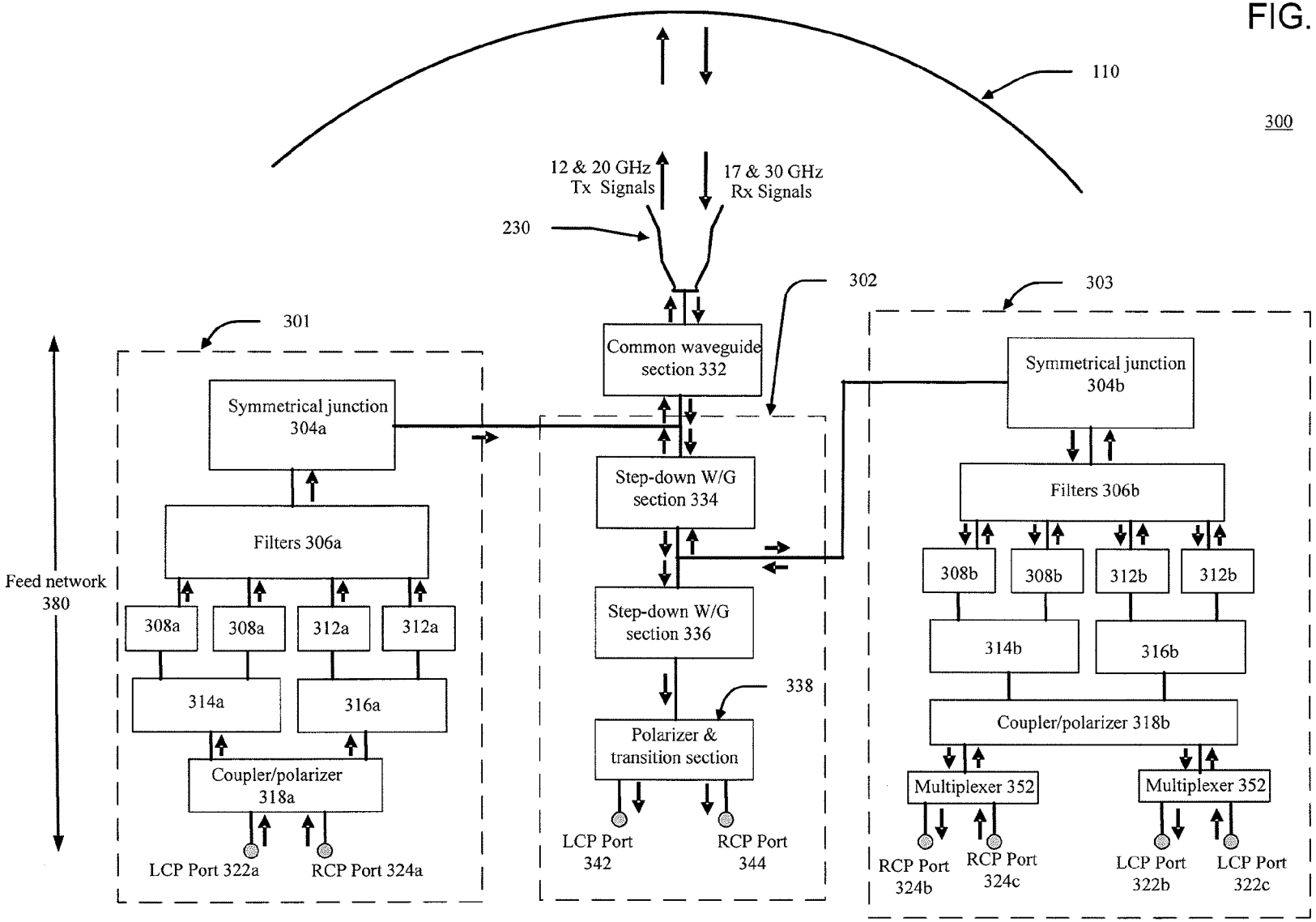
FIG. 3 illustrates a simplified block diagram of a quad-band antenna system according to an exemplary embodiment of the present invention.

FIG. 3 illustrates a simplified block diagram of an antenna system 300 according to an exemplary embodiment of the present invention. The antenna system 300 may be utilized in forward DBS and Ka-band broadband satellite services (e.g., 12 and 20 GHz frequency bands for transmission and 17 and 30 GHz frequency bands for reception). The antenna system 300 includes a horn antenna 230, which may be a multi-band (e.g., quad-band) high efficiency horn antenna, and a feed network 380. It may also include a reflector 110 (e.g., an offset reflector antenna), which may be parabolic or non-parabolic in shape.

The feed network 380 may include a common waveguide section 332 configured to provide matching network to all the radio frequency signals in multiple frequency bands. The feed network 380 may include a number of network blocks. Three network blocks 301, 302, 303 are shown in this example. Each network block may be configured to transmit and/or receive radio frequency signals in one or two of the multiple frequency bands.

The network block 301 includes a symmetrical junction 304*a* having multiple waveguide slots (e.g., 4 slots) coupled to the common waveguide section 332. The symmetrical junction 304*a* may be configured to transmit and/or receive radio frequency signals in first selected one or two frequency bands of the multiple frequency bands and not all of the multiple frequency bands. Multiple filters 306*a* coupled to the symmetrical junction 304*a* may be configured to pass the radio frequency signals in the first selected one or two frequency bands of the multiple frequency bands and configured to reject the radio frequency signals in frequency bands not within the first selected one or more frequency bands of the multiple frequency bands. In this example, the first selected one or more frequency bands may be a 12 GHz frequency band, and the network block 301 may be used to transmit radio frequency signals in the 12 GHz frequency band. The arrows shown indicate an exemplary flow of signals for transmission of the 12 GHz band RF signals.

The network block 301 may also include horizontal plane sections 308*a* and vertical plane section 312*a* for propagating radio frequency signals. A horizontal plane block 314*a* may include (i) horizontal plane waveguide bend sections, each of which may be coupled to its respective filter 306*a*, and (ii) a horizontal plane T-junction coupled to the horizontal plane waveguide bend sections and configured to divide radio frequency signals into horizontal plane radio frequency signals for transmission and to combine horizontal plane radio frequency signals into radio frequency signals for reception.

A vertical plane block 316*a* may include (i) vertical plane waveguide bend sections, each of which may be coupled to its respective filter 306*a*, and (ii) a vertical plane T-junction coupled to the vertical plane waveguide bend sections and configured to divide radio frequency signals into vertical plane radio frequency signals for transmission and to combine vertical plane radio frequency signals into radio frequency signals for reception.

A hybrid coupler/polarizer 318*a* may be configured to combine or divide radio frequency signals and to polarize radio frequency signals from one form to another form (e.g., converting linearly polarized signals to circularly polarized signals and vice versa). The hybrid coupler/polarizer 318*a* is coupled to a left-hand circular polarization (LCP) port 322*a* and a right-hand circular polarization (RCP) port 324*a* at the 12 GHz band of this exemplary drawing.

Still referring to FIG. 3, the network module 302 may include a first step-down waveguide section 334 configured to transmit and/or receive the radio frequency signals in second, third, and fourth selected frequency bands of the multiple frequency bands and configured to reject the radio frequency signals in the first selected one or more frequency bands of the multiple frequency bands. The network module 302 may further include a second step-down waveguide section 336 configured to transmit and/or receive the radio frequency signals in fourth selected one or more frequency bands of the multiple frequency bands and configured to reject the radio frequency signals in the second and third selected frequency bands of the multiple frequency bands. In this example, the second selected one or more frequency bands may include 17 GHz frequency bands, the third selected frequency bands may include 20 GHz frequency bands, which are handled by the network module 303, and the fourth selected frequency bands may include 30 GHz frequency band, which is handled by the network module 302.

The network module 302 may further include a polarizer (e.g., a septum polarizer) and a transition section 338 coupled to the second step-down waveguide section 336. The polarizer of block 338 may be configured to polarize signals from one form to another form, like the polarizer of the block 318*a* described above. The transition section of block 338 may be configured to provide one of the polarized signal to an LCP (left-hand circular polarization) port 342, and the other polarized signal to an RCP (right-hand circular polarization) port 344.

The network module 303 may include components similar to those in the network module 301, and the similar components can perform the same or similar functions. A symmetrical junction 304*b* is similar to the symmetrical junction 304*a*, filters 306*b* are similar to filters 306*a*, horizontal plane sections 308*b* are similar to horizontal plane sections 308*a*, and vertical plane sections 312*b* are similar to vertical plane sections 312*a*. A horizontal plane block 314*b* may be similar to the horizontal plane block 314*a*. A vertical plane block 316*b* may be similar to the vertical plane block 316*a*. A hybrid coupler/polarizer 318*b* is similar to the hybrid coupler/polarizer 318*a*.

The network module 303 may include components different from the network module 301. For example, the network module 303 may include multiplexers 352 (e.g., diplexers) coupled to the hybrid coupler and polarizer 318*a*. The multiplexers 352 (e.g., diplexers) can be used to isolate two or more frequency bands from one another and provide multiple ports for RF signals associated with multiple frequency bands.

In this particular example shown in FIG. 3, the network module 303 is configured to transmit radio frequency signals in one frequency band for broadband communications (e.g., 20 GHz frequency band) and to receive radio frequency signals in another frequency band (e.g., 17 GHz frequency band) for DBS broadcast. For transmission, the multiplexers 352 may select the LCP port 322*c* (e.g., signals in the 20 GHz frequency band) and select the RCP port 324*c* (e.g., signals in the 20 GHz frequency band). For reception, the multiplexers 352 may provide signals to the RCP port 324*b* (e.g., signals in the 17 GHz frequency band) and provide signals to the LCP port 322*b* (e.g., signals in the 17 GHz frequency band).

In accordance with one exemplary embodiment, the antenna system 300 may be configured to transmit and/or receive radio frequency signals in four frequency bands and utilize eight ports (322*a*, 324*a*, 342, 344, 324*b*, 324*c*, 322*b*, and 322*c*). In particular, the antenna system 300 may be configured to transmit radio frequency signals in the 12 GHz and 20 GHz frequency bands and receive radio frequency signals in the 17 GHz and 30 GHz frequency bands. The horn antenna 230 may also be configured to transmit radio frequency signals in the 12 GHz and 20 GHz frequency bands and receive radio frequency signals in the 17 GHz and 30 GHz frequency bands. The arrows shown in FIG. 3 indicate the direction of flow of RF signals. The network module 301 may be configured to transmit to the common waveguide section 332 radio frequency signals in the 12 GHz frequency band. The filters 306*a* may be configured to selectively pass radio frequency signals in the 12 GHz frequency band and reject radio frequency signals in the 17, 20 and 30 GHz frequency bands. The symmetrical junction 304*a* may be configured to pass the radio frequency signals in the 12 GHz frequency band to the common waveguide section 332.

The network module 302 may be configured to reject radio frequency signals in the 12 GHz frequency band (by the first step-down waveguide section 334) and the reject the 17 and 20 GHz frequency bands (by the second step-down waveguide section 336) so that only the radio frequency signals in the 30 GHz frequency band are sent to the LCP port 342 and RCP port 344.

In the network module 303, the filters 306*b* may be configured to reject radio frequency signals in the 30 GHz frequency band. The symmetrical junction 304*b* may be configured to receive radio frequency signals in the 17 GHz frequency band from the first step-down waveguide section 334, and configured to transmit radio frequency signals in the 20 GHz frequency band to the first step-down waveguide section 334.

In this example, the network module 301 handles the lowest frequency band, the network module 302 handles the highest frequency band, and the network module 303 handles two medium frequency bands (between the highest and the lowest frequency bands) that are close together.

As for the eight ports shown in FIG. 3, both the LCP port 322*a* and RCP port 324*a* in the network module 301 may be used for the 12 GHz frequency band. The LCP port 342 and RCP port 344 in the network module 302 may be used to receive radio frequency signals in the 30 GHz frequency band. The RCP port 324*b* and the RCP port 324*c* may be used to receive signals in the 17 GHz frequency band and to transmit signals in the 20 GHz frequency band, respectively. The LCP port 322*b* and the LCP port 322*c* may be used to receive signals in the 17 GHz frequency band and to transmit signals in the 20 GHz frequency band, respectively. It should be noted that the arrows indicating the flow of signals are drawn for an antenna system on a satellite. An antenna system for a ground terminal may utilize the same components but the signals will flow in reverse direction as the transmit and receive functions are reversed for the ground application.

Figure 4:
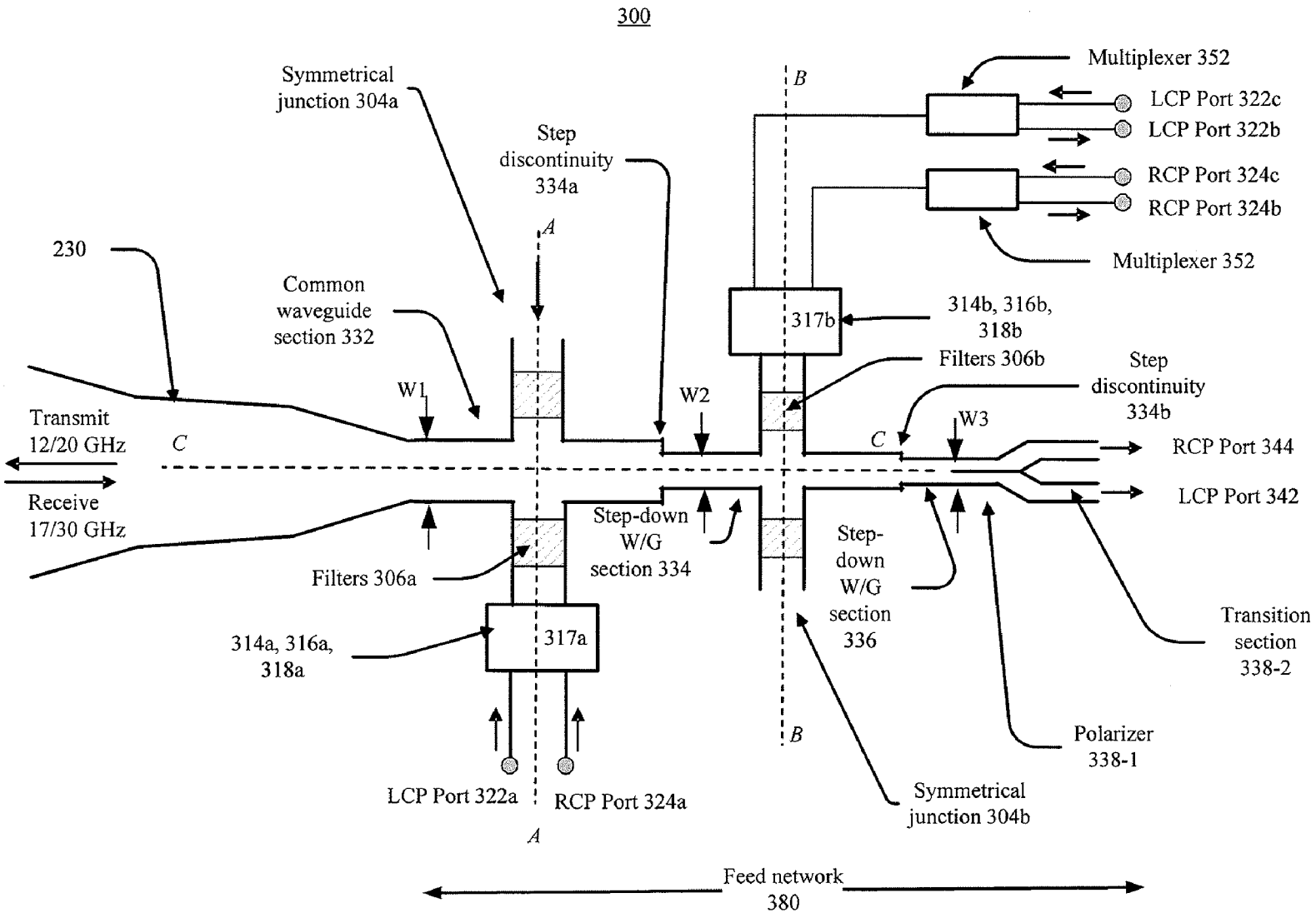
FIG. 4 is an exemplary diagrammatic sectional view depicting the feed system of FIG. 3 according to one exemplary embodiment of the present invention.

FIG. 4 is a diagrammatic sectional view depicting the antenna system 300 of FIG. 3. Like components are labeled with identical element numbers for ease of understanding. Some of the components such as blocks 314*a*, 316*a*, 318*a* are combined into one waveguide bend sections & combiner block 317*a*, and blocks 314*b*, 316*b* and 318*b* are combined into one waveguide bend sections & combiner block 317*b* in FIG. 4. The polarizer & transition section 338 is shown as a polarizer 338-1 and a transition section 338-2. In one embodiment, the horn antenna 230, the common waveguide section 332, the symmetrical junction 304*a*, a first step-down waveguide section 334, a second step-down waveguide section 336, the polarizer 338-1, and the transition section 338-2 are disposed concentrically around a common axis C-C.

As shown in FIG. 4, the antenna system 300 may include three waveguide sections (332, 334 and 336). The diameter (W1) of the common waveguide section 332 (which is the closest waveguide section to the horn antenna 230) is the largest of the three waveguide sections 332, 334 and 336. The diameter (W3) of the second step-down waveguide section 336 (which is the farthest one from the horn antenna 23) is the smallest. The diameter (W2) of the first step-down waveguide section 334 (which is located between 332 and 336) is less than W1 but greater than W3. The diameter of the common waveguide section 332 is made sufficiently large so that all frequency bands (e.g., 12, 17, 20 and 30 GHz) can propagate in the common waveguide section 332. On the other hand, the diameter of the second step-down waveguide section 336 is made sufficiently small so that it allows the higher frequency signals (e.g., 30 GHz) to propagate but not the lower frequency signals (e.g., 12, 17 or 20 GHz).

In FIG. 4, according to one aspect, the diameter of each of the waveguide sections 332, 334 and 336 is constant within its respective waveguide section. When a waveguide section transitions from one section to the next, it utilizes a step discontinuity (e.g., 334*a* and 334*b*) according to one embodiment. Step discontinuity can include a surface having a ninety-degree slope with respect to the axis C-C. The subject technology, however, is not limited to this configuration and may utilize other types of transitions.

Figure 5:
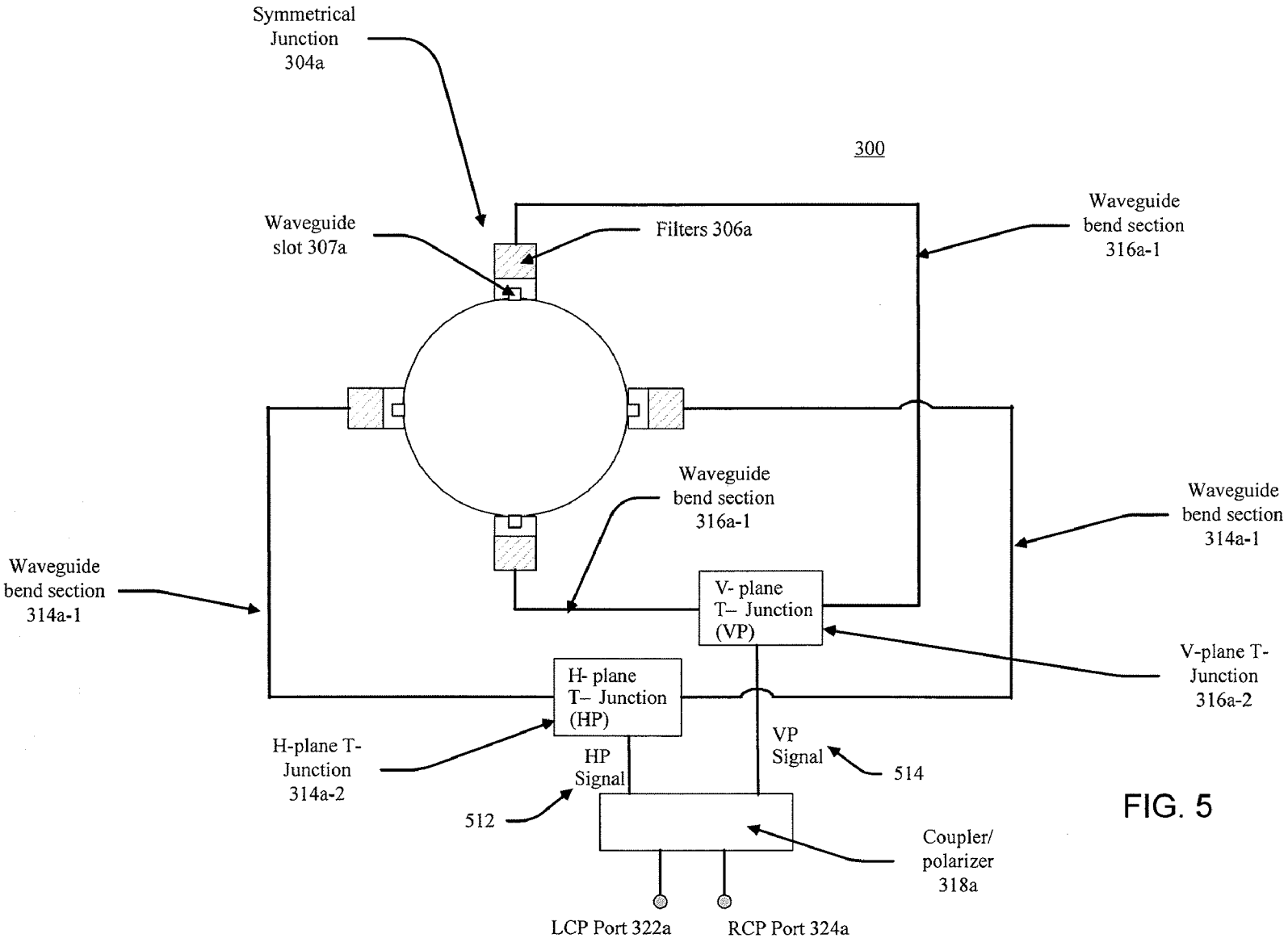
FIG. 5 is an exemplary diagrammatic sectional view depicting the symmetrical junction of the feed system of FIG. 3 according to one exemplary embodiment of the present invention.

FIG. 5 is a diagrammatic sectional view depicting the antenna system 300 shown along A-A of FIG. 4 according to one exemplary embodiment. The horizontal plane block 314*a* is shown with (i) two waveguide bend sections 314*a*-1 for the horizontal plane and (ii) a horizontal plane T-junction 314*a*-2. The vertical plane block 316*a* is shown with (i) two waveguide bend sections 316*a*-1 for the vertical plane and (ii) a vertical plane T-junction 316*a*-2. For transmission of signals, a coupler/polarizer (such as 318*a*, which may include a 3-dB hybrid coupler) is configured to phase shift a signal by 90° (e.g., HP and VP signals 512 and 514 are equal in amplitude and 90° out of phase). A coupler/polarizer (such as 318*a*) is also configured to place a half of the power from the LCP port 322*a* onto the VP signal 514, the other half of the power from the LCP port 322*a* onto the HP signal 512, a half of the power from the RCP port 324*a* onto the VP signal 514, the other half of the power from the RCP port 324*a* onto the HP signal 512. If a coupler/polarizer is utilized for reception of signals, a coupler/polarizer (such as 318*a*) can combine and polarize the HP and VP signals 512 and 514 into the LCP port 322*a* and RCP port 324*a*.

The symmetrical junction 304*a* is symmetrical and may include four waveguide slots 307*a* (two for the vertical plane and two for the horizontal plane). The two waveguide slots 307*a* for the vertical plane are located at opposite ends of a circular body of the symmetrical junction 304*a* (one on top and one on the bottom), and the two waveguide slots 307*a* for the horizontal plane are located at opposite ends of the body (one on the left and one on the right). The four slots located 90 degrees apart along the circumference of the circular waveguide create a symmetrical structure. The waveguide slots 307*a* are configured to be resonant at its selected frequency band(s) (e.g., 12 GHz frequency band). The four filters 306*a* may be configured to reject radio frequency signals in the other frequency bands (e.g., 17, 20 and 30 GHz frequency bands) as well as other frequencies such as radio-astronomy bands and military bands for proper operation of the satellite. It should be noted that the horizontal and vertical plane sections 308*a* and 312*a* shown in FIG. 3 are considered to be part of the filters 306*a* in FIG. 5, and thus the horizontal and vertical plane sections 308*a* and 312*a* are not explicitly shown in FIG. 5.

Figure 6:
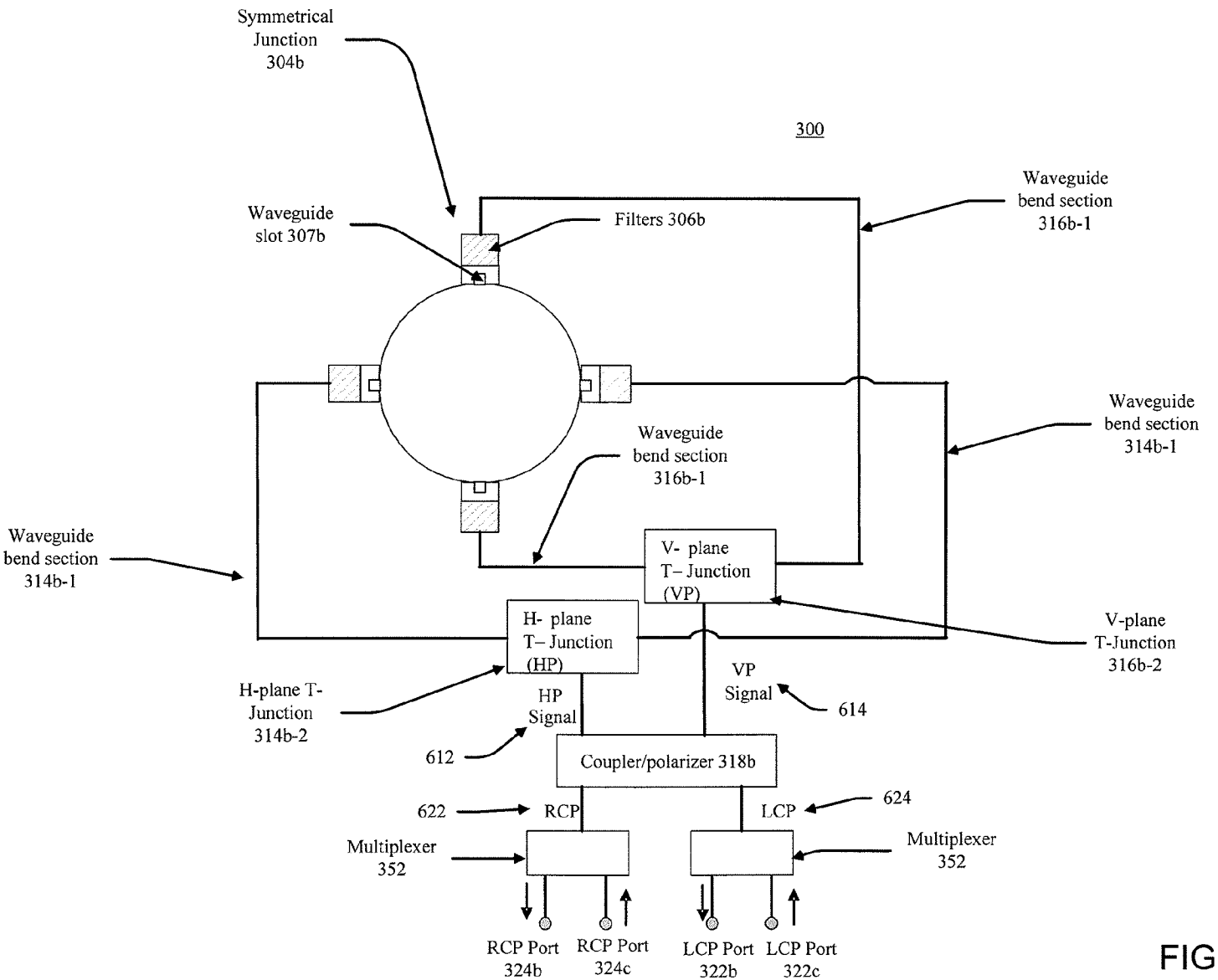
FIG. 6 is an exemplary diagrammatic sectional view depicting yet another symmetrical junction of the feed system of FIG. 3 according to one exemplary embodiment of the present invention.

FIG. 6 is a diagrammatic sectional view depicting the antenna system 300 shown along B-B of FIG. 4 according to one exemplary embodiment. The horizontal plane block 314*b* is shown with (i) two waveguide bend sections 314*b*-1 for the horizontal plane and (ii) a horizontal plane T-junction 314*b*-2. The vertical plane block 316*b* is shown with (i) two waveguide bend sections 316*b*-1 for the vertical plane and (ii) a vertical plane T-junction 316*b*-2. For transmission of signals, one (right) multiplexer 352 may select the LCP port 322*c* (e.g., for 20 GHz) to place the signal from the LCP port 322*c* onto the LCP signal 624, and the other (left) multiplexer 352 may select the RCP port 324*c* (e.g., for 20 GHz) to place the signal from the RCP port 324*c* onto the RCP signal 622. For reception of signals, one (left) multiplexer 352 may select the RCP port 324*b* (e.g., for 17 GHz) and place the RCP signal 622 onto the RCP port 324*b*. The other (right) multiplexer 352 may select the LCP port 322*b* (e.g., for 17 GHz) and place the LCP signal 624 onto the LCP power 322*b*.

For transmission of signals, a coupler/polarizer (such as 318*b*, which includes a 3-dB hybrid coupler) is configured to phase shift a signal by 90° (e.g., HP and VP signals 612 and 614 are equal in amplitude and 90° out of phase). A coupler/polarizer (such as 318*b*) is also configured to place a half of the power from the LCP signal 624 onto the VP signal 614, the other half of the power from the LCP signal 624 onto the HP signal 612, a half of the power from the RCP signal 622 onto the VP signal 614, the other half of the power from the RCP signal 622 onto the HP signal 612. If a coupler/polarizer is utilized for reception of signals, a coupler/polarizer (such as 318*b*) can combine and polarize the HP and VP signals 612 and 614 into the RCP and LCP signals 622 and 624.

The symmetrical junction 304*b* is symmetrical and may include four waveguide slots 307*b* (two for the vertical plane and two for the horizontal plane). The two waveguide slots 307*b* for the vertical plane are located at opposite ends of a circular body of the symmetrical junction 304*b* (one on top and one on the bottom), and the two waveguide slots 307*b* for the horizontal plane are located at opposite ends of the body (one on the left and one on the right). The locations of the waveguide slots are symmetrical. The waveguide slots 307*b* may be configured to be resonant at the selected frequency band(s) (e.g., 17 and 20 GHz frequency bands). The four filters 306*b* may be configured to reject radio frequency signals in the non-selected frequency bands (e.g., higher frequency bands such as the 30 GHz frequency band). It should be noted that the horizontal and vertical plane sections 308*b* and 312*b* shown in FIG. 3 are considered to be part of the filters 306*b* in FIG. 6, and thus the horizontal and vertical plane sections 308*b* and 312*b* are not explicitly shown in FIG. 6.

Figure 7:
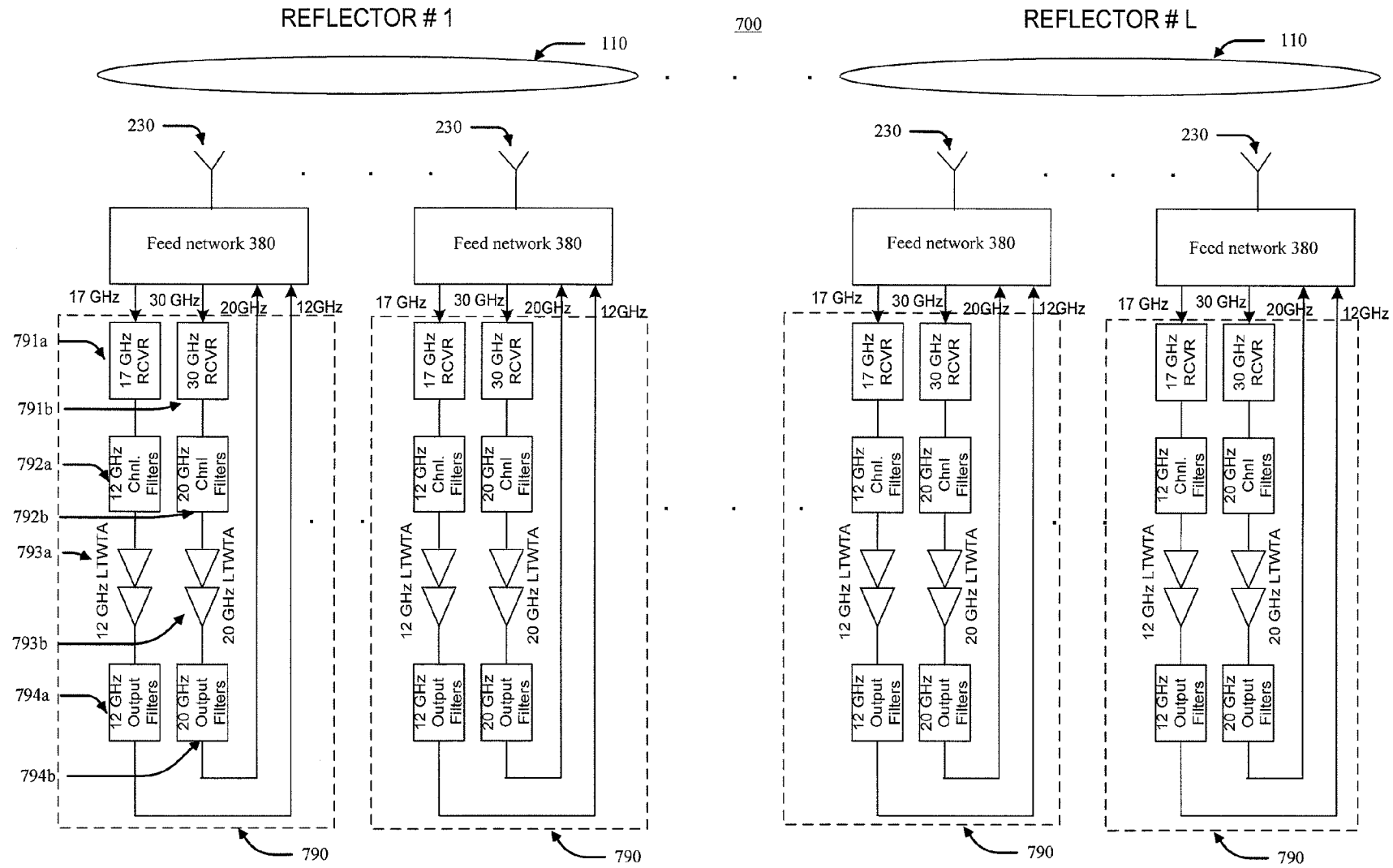
FIG. 7 is a simplified system block diagram utilizing the exemplary antenna system according to one exemplary embodiment of the present invention.

FIG. 7 is a simplified block diagram of an exemplary antenna system. An antenna system 700 may be utilized, for example, in forward DBS and Ka-band broadband satellite services (e.g., 12 and 20 GHz frequency bands for transmission and 17 and 30 GHz frequency bands for reception). The antenna system 700 may include a number of reflectors 110 (reflector #1 through reflector #L). Each reflector 110 may be fed by a cluster of horn antennas 230. Each horn antennas 230 is coupled to its corresponding feed network 380. Each feed network 380 is in turn coupled to its corresponding repeater block 790. The ports (e.g., the arrows identified with 17 GHz, 30 GHz, 20 GHz, and 12 GHz) between the feed network 380 and the repeater block 790 are shown as 4 ports, but each port represents an LCP port and an RCP port. Thus, in this example, there are eight ports for each feed network 380. These ports are the LCP port 322*a*, RCP port 324*a*, LCP port 342, RCP port 344, RCP port 324*b*, RCP port 324*c*, LCP port 322*b* and LCP port 322*c*, shown in FIGS. 3-6.

A repeater 790 includes a receiver block 791*a* (e.g., for the 17 GHz frequency band) configured to downcovert the radio frequency signals received, channel filters 792*a* configured to selectively pass signals in a selected frequency band(s) (e.g., 12 GHz frequency band) and reject other frequency bands, linearized traveling wave tube amplifiers (LTWTAs) 793*a* configured to operate, for example, at 12 GHz and to amplify the signals, and output filters 794*a* configured to selectively pass signals in a selected frequency band(s) (e.g., 12 GHz frequency band) and reject other frequency bands.

FIG. 7 also shows a set of blocks 791*b*, 792*b*, 793*b*, and 794*b* configured to operate on radio frequency signals in the 30 GHz frequency band in a manner identical to blocks 791*a*, 792*a*, 793*a*, and 794*a* but for a different frequency band (e.g., for 30 GHz rather than 17 GHz). A repeater block 790 can be configured to receive radio frequency signals at first selected frequency band or bands (e.g., 17 and 30 GHz) and to transmit the radio frequency signals at second selected frequency band or bands (e.g., 12 and 20 GHz). It is possible that each of the horn antenna 230, the feed network 380, and the repeater block 790 may receive a radio frequency signal(s) in one or more frequency bands selected and simultaneously transmit a radio frequency signal(s) at one or more other frequency bands selected.

Figure 8:
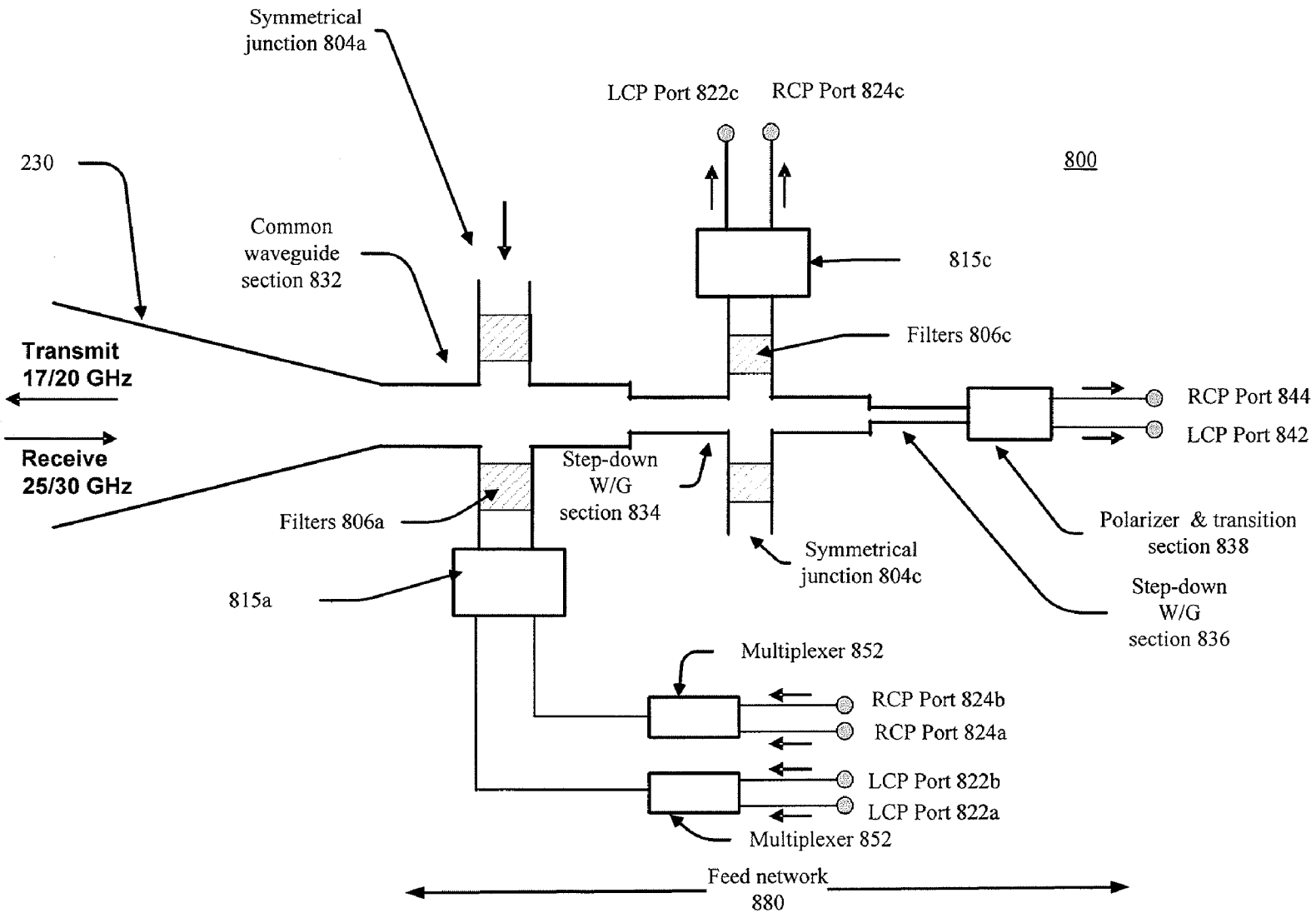
FIG. 8 is a diagrammatic sectional view depicting an exemplary antenna system according to yet another exemplary embodiment of the present invention.

FIG. 8 is a diagrammatic sectional view depicting an exemplary antenna system that may operate in the reverse DBS and Ka-band broadband (e.g., 17, 20, 25 and 30 GHz). Like the antenna system 300 in FIGS. 3-6, the antenna system 800 includes a horn antenna 230 and a feed network 880.

Components with like names can perform the same or substantially similar functions. For example, a symmetrical junctions 804*a* (e.g., passing 17 and 20 GHz frequency bands) and 804*c* (e.g., passing 25 GHz frequency band) are similar to symmetrical junctions 304*a* and 304*b*. A common waveguide section 832 (e.g., passing all of 17, 30, 25 and 30 GHz frequency bands) is similar to the common waveguide section 332.

Filters 806*a* (e.g., passing 17 and 20 GHz frequency bands and rejecting 25 and 30 GHz frequency bands) and 806*c* (e.g., passing 25 GHz frequency band and rejecting 30 GHz frequency band) of FIG. 8 are similar to the filters 306*a* and 306*b* of FIGS. 3-6. Waveguide bend sections & combiner 815*a* (e.g., passing 17 and 20 GHz frequency bands) and 815*c* (e.g., passing 25 GHz frequency bands) are similar to the waveguide bend sections & combiner 317*a* and 317*b*.

Step-down waveguide sections 834 (e.g., passing 25 and 30 GHz frequency bands) and 836 (e.g., passing 30 GHz frequency band) are similar to the step-down waveguide sections 334 and 336. A polarizer & transition section 838 (e.g., passing 30 GHz frequency band) is similar to the polarizer & transition section 338. The multiplexers 852 (e.g., passing 17 and 20 GHz frequency bands) are similar to the multiplexers 352. RCP and LCP ports 824*a*, 824*b*, 822*a*, 822*b*, 822*c*, 824*c*, 842 and 844 are similar to RCP and LCP ports 324*a*, 324*b*, 322*a*, 322*b*, 322*c*, 324*c*, 342 and 344 of FIGS. 3-6.

One difference between the like-named components in FIG. 8 and FIGS. 3-6 is that the transmission and reception frequency bands are different. FIG. 8 depicts, for example, 17 and 12 GHz frequency bands as the transmission frequency bands and 25 and 30 GHz frequency bands as the reception frequency bands.

The filters 806*a* may be used to selectively pass radio frequency signals in the lowest frequency bands (e.g., 17 and 20 GHz frequency bands) and reject the other frequency bands (e.g., 25 and 30 GHz). Since 17 and 20 GHz are the close in frequency, these frequency bands are grouped together to be handled using same hardware. The filters 806*c* may be used to selectively pass radio frequency signals in the 25 GHz frequency band and reject the other high frequency band(s) (e.g., 30 GHz). The RCP port 824*b* and LCP port 822*a* may carry transmission signals in the 20 GHz frequency band. The RCP port 824*a* and LCP port 822*b* may carry transmission signals in the 17 GHz frequency band. The RCP port 824*c* and LCP port 822*c* may carry reception signals in the 25 GHz frequency band. The RCP port 844 and LCP port 842 may carry reception signals in the 30 GHz frequency band.

Figure 9:
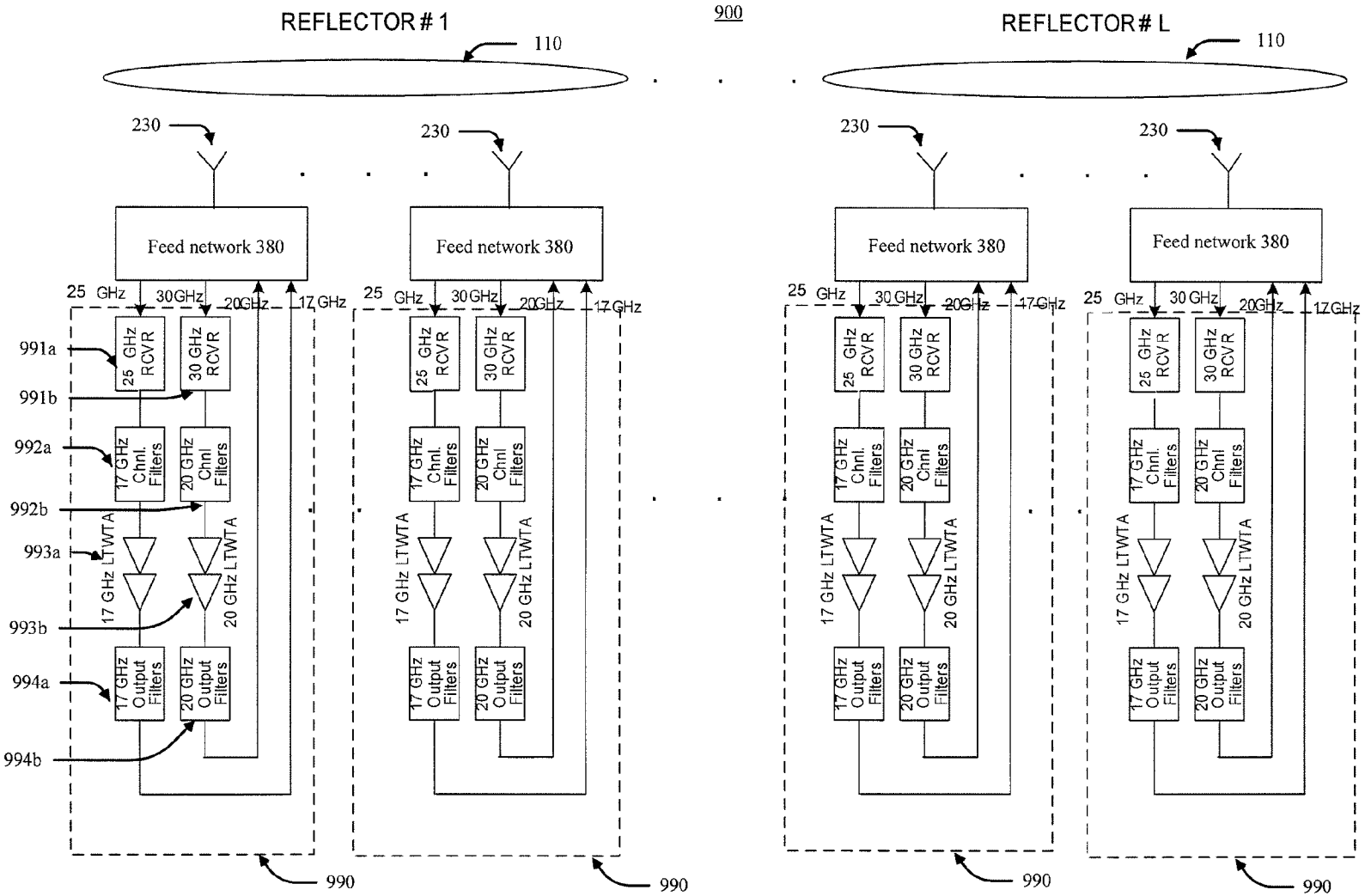
FIG. 9 is a simplified system block diagram utilizing yet another exemplary antenna system according to another exemplary embodiment of the present invention.

FIG. 9 is a simplified block diagram of an exemplary antenna system. An antenna system 900 may include a number of reflectors 110 (reflector #1 through reflector #L). Each reflector 110 may be fed by a cluster of horn antennas 230. The antenna system 900 may be utilized, for example, in reverse DBS and Ka-band broadband satellite services (e.g., 17 and 20 GHz frequency bands for transmission and 25 and 30 GHz frequency bands for reception). The components shown in FIG. 9 (e.g., 991*a*, 991*b*, 992*a*, 992*b*, 993*a*, 993*b*, 994*a*, 994*b*) are similar to those in FIG. 7 (e.g., 791*a*, 791*b*, 792*a*, 792*b*, 793*a*, 793*b*, 794*a*, 794*b*), and they perform identical or similar functions, except that the frequency bands are different.

Figures 10A, 10B, 10C:
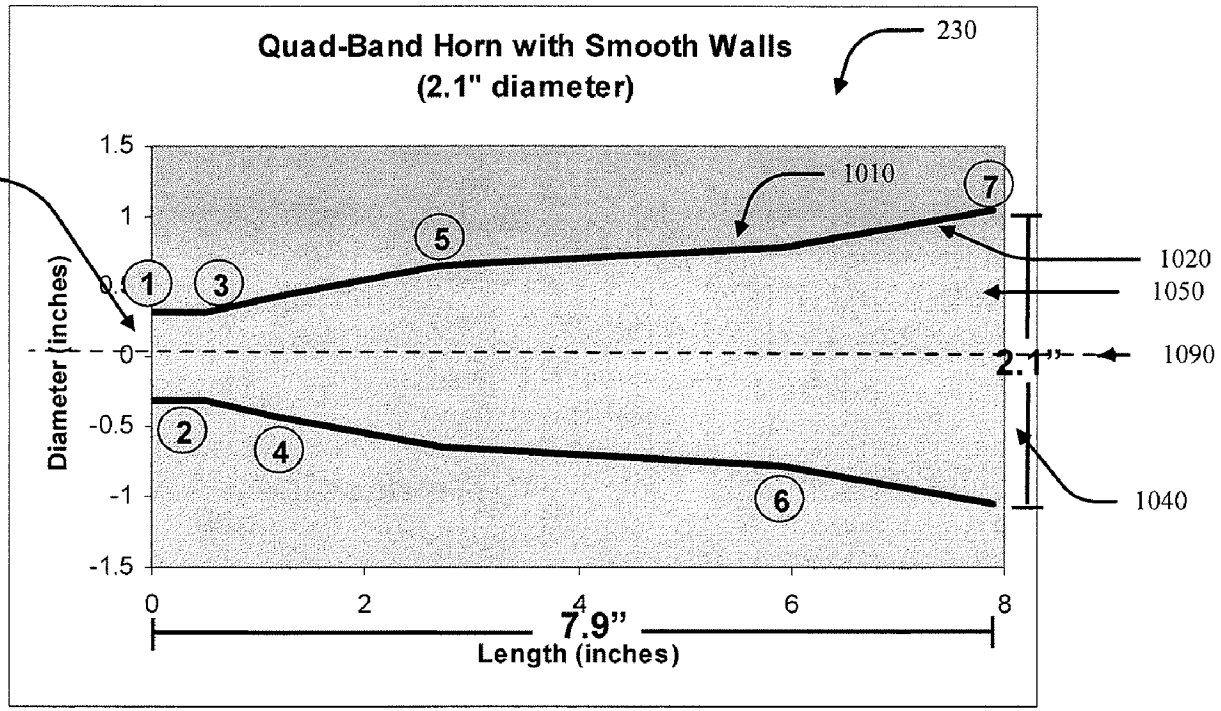
FIG. 10A is the geometry of a quad-band horn antenna according to an exemplary embodiment of the present invention.
FIG. 10B illustrates exemplary dimensions of a quad-band horn antenna according to an exemplary embodiment of the present invention.
FIG. 10C illustrates exemplary performance of the quad-band horn in terms of return loss, cross-polarization, and efficiency at various frequencies.

FIG. 10A is the synthesized geometry of a quad-band horn antenna designed to support the 12 GHz and 17 GHz bands for forward DBS and the 20 GHz and 30 GHz bands for the broadband service, according to an exemplary embodiment of the present invention. The horn is circularly symmetric around its axis (shown as dotted line) and the figure illustrates a side, cut-away view of horn antenna 230. Horn antenna 230 comprises an exterior surface 1010, an interior surface 1020, a throat 1030, and an aperture 1040. The interior surface 1020 is disposed in the horn antenna 230. The throat 1030 is disposed at location 1 (a first end) of the horn antenna 230. The aperture 1040 is disposed distantly from the throat 1030 at location 7 (a second end) of the horn antenna 230. The interior surface 1020 may be an electrically conductive metal or metallic material (e.g., electroformed copper and/or aluminum) that allows for reception and/or transmission of radio frequency signals. Exterior surface 1030 may also be metal or metallic.

A hollow area 1050 is substantially funnel-shaped, and is formed within horn antenna 230. The hollow area 1050 extends from the throat 1030 to the aperture 1040 in a gradually tapered fashion along multiple slope discontinuities 2, 3, 4, 5, and 6. In various exemplary embodiments, each of the slope discontinuities 2, 3, 4, 5, and 6 may be located at varying distances from one another. In various exemplary embodiments, there may be any number of slope discontinuities, to include more than five or less than five.

FIG. 10B illustrates exemplary dimensions of the interior surface 1020 at various locations 1 through 7. For example, at location 1 (the first end of the horn antenna 230), the diameter of the interior surface 1020 (which is the diameter of the throat 1030) is about 0.640 inches. The throat 1030 is flat; hence, at location 2, the diameter of the interior surface 1020 remains at about 0.640 inches. Location 2 is at about 0.200 inches from location 1. The throat 1030 may include a known type of radio frequency feed network that was discussed in FIGS. 3-6.

At location 3, the diameter of the interior surface 1020 is about 0.646 inches, and location 3 is about 0.506 inches from location 1. At location 4, the diameter of the interior surface 1020 is about 0.877 inches, and location 4 is about 1.175 inches from location 1. At location 5, the diameter of the interior surface 1020 is about 1.299 inches, and location 5 is about 2.718 inches from location 1. At location 6, the diameter of the interior surface 1020 is about 1.560 inches, and location 6 is about 5.918 inches from location 1. At location 7 (the second end of the horn antenna 230), the diameter of the interior surface 1020 is about 2.1 inches, and location 7 is about 7.901 inches from location 1. Location 7 may be covered by a protective covering (not illustrated) known to not interfere with radio frequency transmission and reception. A protective covering might be utilized to keep debris and unwanted material from entering the hollow area 1050.

While the interior surface 1020 is referred to herein as possessing a "diameter," those skilled in the art would understand that a horn antenna 230 may have a variety of shapes, and that an aperture 1040 may be circular, elliptical, rectangular, square, polygonal, or some other configuration all within the scope of the present invention. Various exemplary embodiments of the present invention may also have different cross sectional shapes along a longitudinal axis, such as circular, rectangular, elliptical, or the like for either circular or linear polarization.

In certain exemplary embodiments of the present invention, if one were to place an axis 1090 lengthwise along the horn antenna 230 between location 1 (where the throat 1030 is) and location 7 (where the aperture 1040 is), coaxial to the center of the horn antenna 230, it is clear that none of the interior surface 1020 reaches a negative slope with respect to the axis 1090 between location 1 and location 7. In one aspect, the positive slopes of the interior surface 1020 gradually taper from slope discontinuity to slope discontinuity. The interior surface 1020 beyond the throat region (i.e., a region to the right of location 2) comprises linear slopes that are greater than zero and less than ninety degrees in angle with respect to the axis 1090. In one aspect, the interior surface beyond the throat region lacks any surface having a zero degree slope with respect to the axis 1090, and the interior surface beyond the throat lacks any surface having a ninety-degree slope with respect to the axis 1090. Furthermore, in some embodiments, the interior surface 1020 beyond the throat region may lack curved surfaces (e.g., the regions between the slope discontinuities are not curved).

The slopes of the interior surface 1020 may taper gradually without any abrupt changes. For example, in certain exemplary embodiments of the present invention, the slope discontinuities do not include a sharp change such as a ninety-degree angle. In one aspect of certain exemplary embodiments, the slope discontinuities shown in FIG. 10A therefore do not represent what those of skill in the art may refer to as "corrugations."

When tested, the exemplary embodiment of the present invention described in relation to FIG. 10A produced the properties shown in FIG. 10C, which describes exemplary values of a return loss, cross-polarization, and efficiency at a given frequency. It demonstrates that an exemplary horn antenna of the subject technology can achieve high efficiency values of 74% to 82% over the four frequency bands (e.g., four frequency bands in 12 GHz-30 GHz).

Horn antennas and systems are also described in the following patent applications: U.S. patent application Ser. No. 12/137,416 entitled "Horn Antenna And System For Transmitting And/Or Receiving Radio Frequency Signals In Multiple Frequency Bands," filed on Jun. 11, 2008, which is a continuation-in-part of U.S. patent application Ser. No. 11/594,157 entitled "High-Efficiency Horns for an Antenna System," filed on Nov. 8, 2006, which is a continuation-in-part of U.S. patent application Ser. No. 11/029,390 entitled "Multiple-Beam Antenna System Using High-Efficiency Dual-Band Feed Horns," filed on Jan. 6, 2005, which claims the benefit of priority under 35 U.S.C. §119 from U.S. Provisional Patent Application Ser. No. 60/622,785 entitled "Multiple-Beam Antenna Using High-Efficiency Dual-Band Horns," filed on Oct. 29, 2004. U.S. patent application Ser. No. 12/137,416 entitled "Horn Antenna And System For Transmitting And/Or Receiving Radio Frequency Signals In Multiple Frequency Bands," filed on Jun. 11, 2008 claims the benefit of priority under 35 U.S.C. §119 from U.S. Provisional Patent Application Ser. No. 61/030,507 entitled "Antenna Systems and Methods Supporting Multiple Frequency Bands and Multiple Beams," filed on Feb. 21, 2008. All of the foregoing applications described in this paragraph are hereby incorporated by reference in their entirety.

Figure 11A:
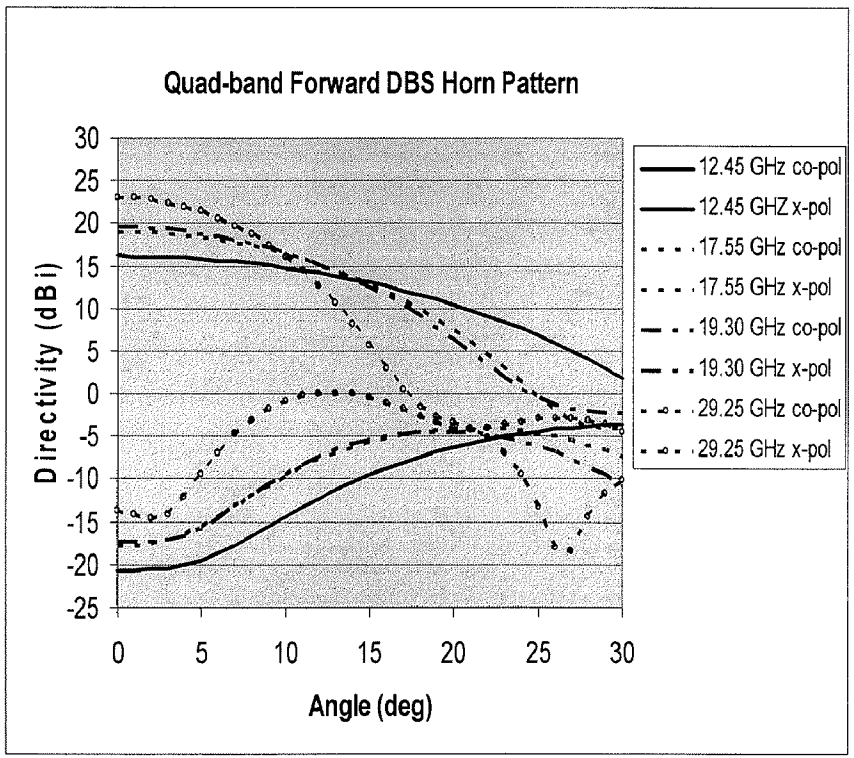
FIG. 11A is an exemplary graph of a primary radiation pattern amplitude for forward DBS taken in accordance with an exemplary embodiment of the present invention.
Figure 11B:
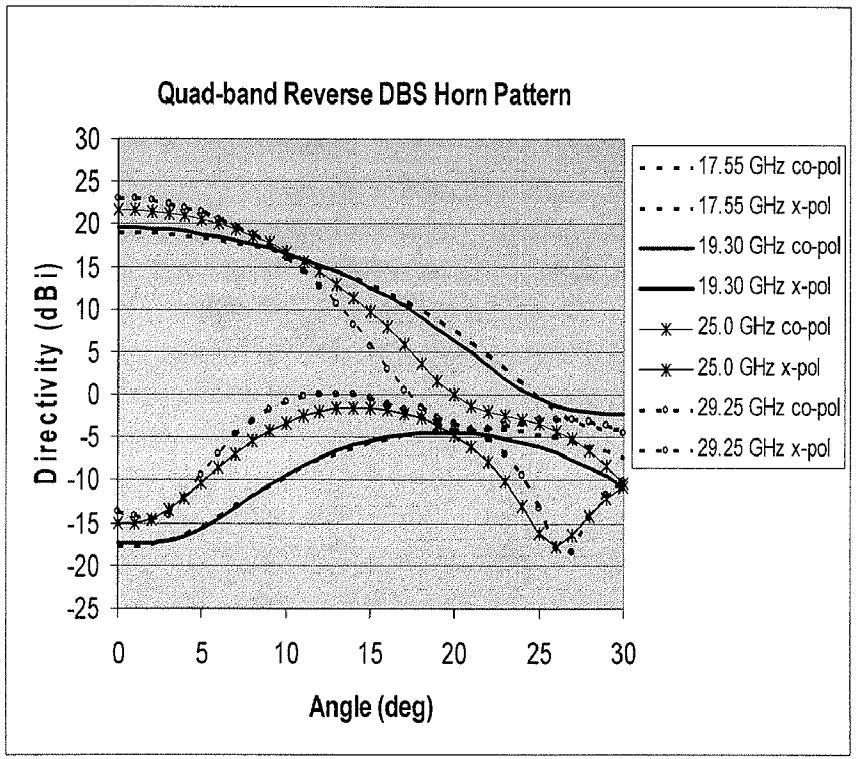
FIG. 11B is an exemplary graph of a primary radiation pattern amplitude for reverse DBS taken in accordance with an exemplary embodiment of the present invention.

FIG. 11A is an exemplary graph of a primary radiation pattern amplitude for forward DBS taken in accordance with an exemplary embodiment of the present invention described in relation to FIGS. 3-7, & 10. FIG. 11B is an exemplary graph of a primary radiation pattern amplitude for reverse DBS taken in accordance with an exemplary embodiment of the present invention described in relation to FIGS. 8-10.

For each of FIGS. 11A and 11B described above, and FIGS. 13A, 13B, 14A, 14B, 15A, 15B, 16A, 16B, 17A, 17B, 18A, and 18B described below, two curves are shown for each frequency, and the higher curve relates to co-polarization, and the lower curve relates to cross-polarization. Notably cross-polarization is generally much less than co-polarization.

Figure 12A:
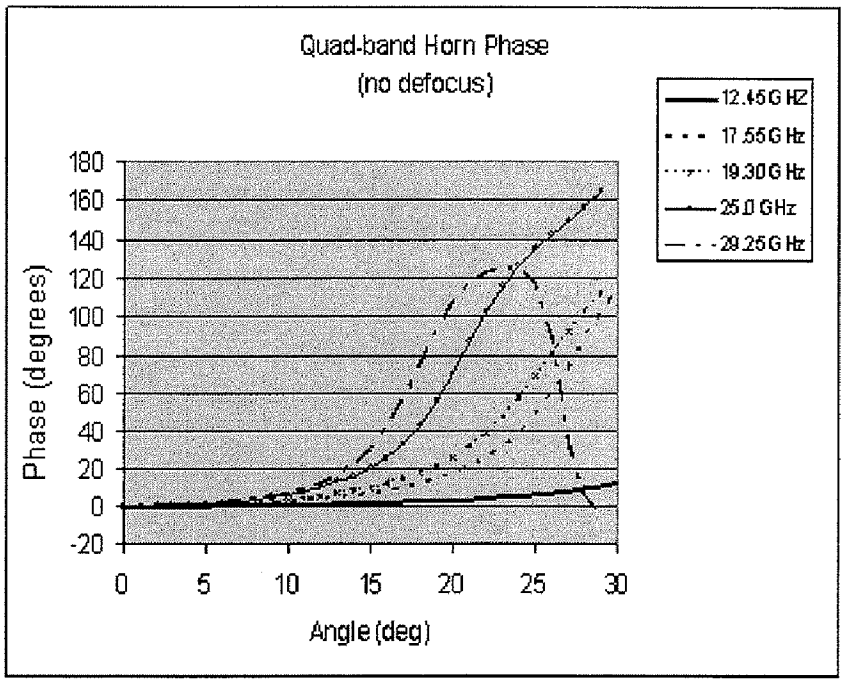
FIG. 12A is an exemplary graph of a primary radiation pattern phase of a horn antenna taken with a defocus of zero inches in accordance with an exemplary embodiment of the present invention.
Figure 12B:
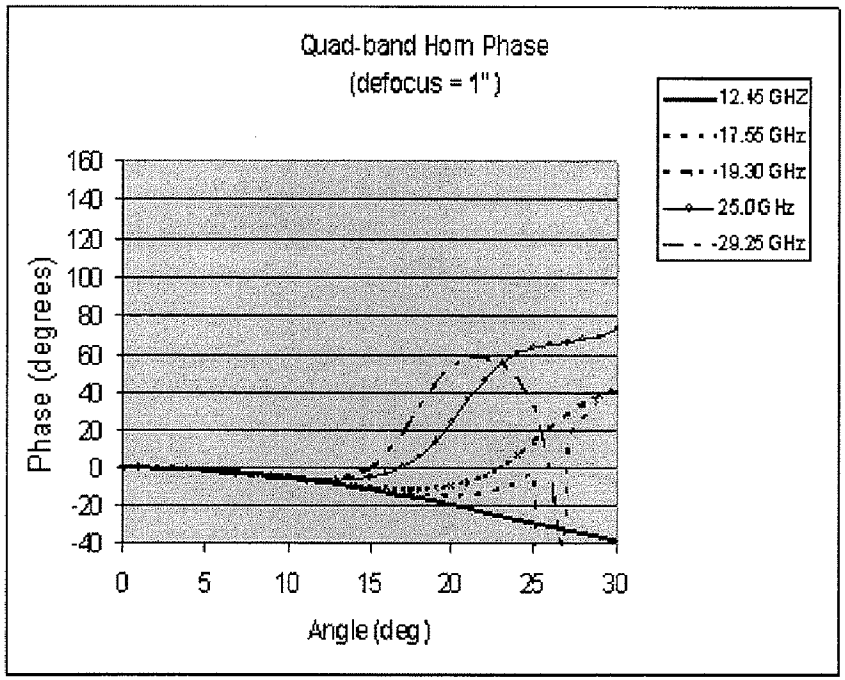
FIG. 12B is an exemplary graph of a primary radiation pattern phase of a horn antenna taken with a defocus of 1 inch in accordance with an exemplary embodiment of the present invention.

FIG. 12A is an exemplary graph of a primary radiation pattern phase of a horn antenna taken with a defocus of zero inches in accordance with an exemplary embodiment of the present invention. It is desirable to have curves that are as flat as possible. Directivity can be optimized for different frequency bands. FIG. 12B is an exemplary graph of a primary radiation pattern phase of a horn antenna taken with a defocus of 1 inch in accordance with an exemplary embodiment of the present invention.

FIG. 13A is an exemplary graph of a secondary radiation pattern of the reflector antenna with the quad-band horn for forward DBS taken with a defocus of zero inches in accordance with an exemplary embodiment of the present invention described in relation to FIGS. 3-7. FIG. 13B is an exemplary graph of a secondary radiation pattern of the reflector antenna with the quad-band horn for reverse DBS taken with a defocus of zero inches in accordance with an exemplary embodiment of the present invention described in relation to FIGS. 8-9. FIG. 13C illustrates an exemplary edge of coverage (EOC) directivity values. It shows exemplary levels of coverage, peak directivity, co-polarization, and the ratio between co-polarization and cross-polarization (C/X) for five frequencies covering forward and reverse DBS bands.

FIG. 14A is an exemplary graph of a secondary radiation pattern of the reflector antenna with the quad-band horn for forward DBS taken with a defocus of 0.5 inches in accordance with an exemplary embodiment of the present invention described in relation to FIGS. 3-7. FIG. 14B is an exemplary graph of a secondary radiation pattern of the reflector antenna with the quad-band horn for reverse DBS taken with a defocus of 0.5 inches in accordance with an exemplary embodiment of the present invention described in relation to FIGS. 8-9. FIG. 14C illustrates an exemplary edge of coverage directivity. It shows exemplary levels of coverage, peak directivity, co-polarization, and the ratio between co-polarization and cross-polarization (C/X) for five frequencies covering forward and reverse DBS bands.

FIG. 15A is an exemplary graph of a secondary radiation pattern of the reflector antenna with the quad-band horn for forward DBS taken with a defocus of 1.0 inch in accordance with an exemplary embodiment of the present invention described in relation to FIGS. 3-7. FIG. 15B is an exemplary graph of a secondary radiation pattern of the reflector antenna with the quad-band horn for reverse DBS taken with a defocus of 1.0 inch in accordance with an exemplary embodiment of the present invention described in relation to FIGS. 8-9. FIG. 15C illustrates an exemplary edge of coverage directivity. It shows exemplary levels of coverage, peak directivity, co-polarization, and the ratio between co-polarization and cross-polarization (C/X) for five frequencies covering forward and reverse DBS bands.

FIG. 16A is an exemplary graph of a secondary radiation pattern of the reflector antenna with the quad-band horn for forward DBS taken with a defocus of 1.5 inches in accordance with an exemplary embodiment of the present invention described in relation to FIGS. 3-7. FIG. 16B is an exemplary graph of a secondary radiation pattern of the reflector antenna with the quad-band horn for reverse DBS taken with a defocus of 1.5 inches in accordance with an exemplary embodiment of the present invention described in relation to FIGS. 8-9. FIG. 16C illustrates an exemplary edge of coverage directivity. It shows exemplary levels of coverage, peak directivity, co-polarization, and the ratio between co-polarization and cross-polarization (C/X) for five frequencies covering forward and reverse DBS bands.

FIG. 17A is an exemplary graph of a secondary radiation pattern of the reflector antenna with the quad-band horn for forward DBS taken with a defocus of 2.0 inches in accordance with an exemplary embodiment of the present invention described in relation to FIGS. 3-7. FIG. 17B is an exemplary graph of a secondary radiation pattern of the reflector antenna with the quad-band horn for reverse DBS taken with a defocus of 2.0 inches in accordance with an exemplary embodiment of the present invention described in relation to FIGS. 8-9. FIG. 17C illustrates an exemplary edge of coverage directivity. It shows exemplary levels of coverage, peak directivity, co-polarization, and the ratio between co-polarization and cross-polarization (C/X) for five frequencies covering forward DBS and reverse DBS bands.

FIG. 18A is an exemplary graph of a secondary radiation pattern of the reflector antenna with the quad-band horn for forward DBS taken with a defocus of 2.5 inches in accordance with an exemplary embodiment of the present invention described in relation to FIGS. 3-7. FIG. 18B is an exemplary graph of a secondary radiation pattern of the reflector antenna with the quad-band horn for reverse DBS taken with a defocus of 2.5 inches in accordance with an exemplary embodiment of the present invention described in relation to FIGS. 8-9.

FIG. 18C illustrates an exemplary edge of coverage directivity. It shows exemplary levels of coverage, peak directivity, co-polarization, and the ratio between co-polarization and cross-polarization (C/X) for five frequencies covering forward DBS and reverse DBS bands.

Figure 19:
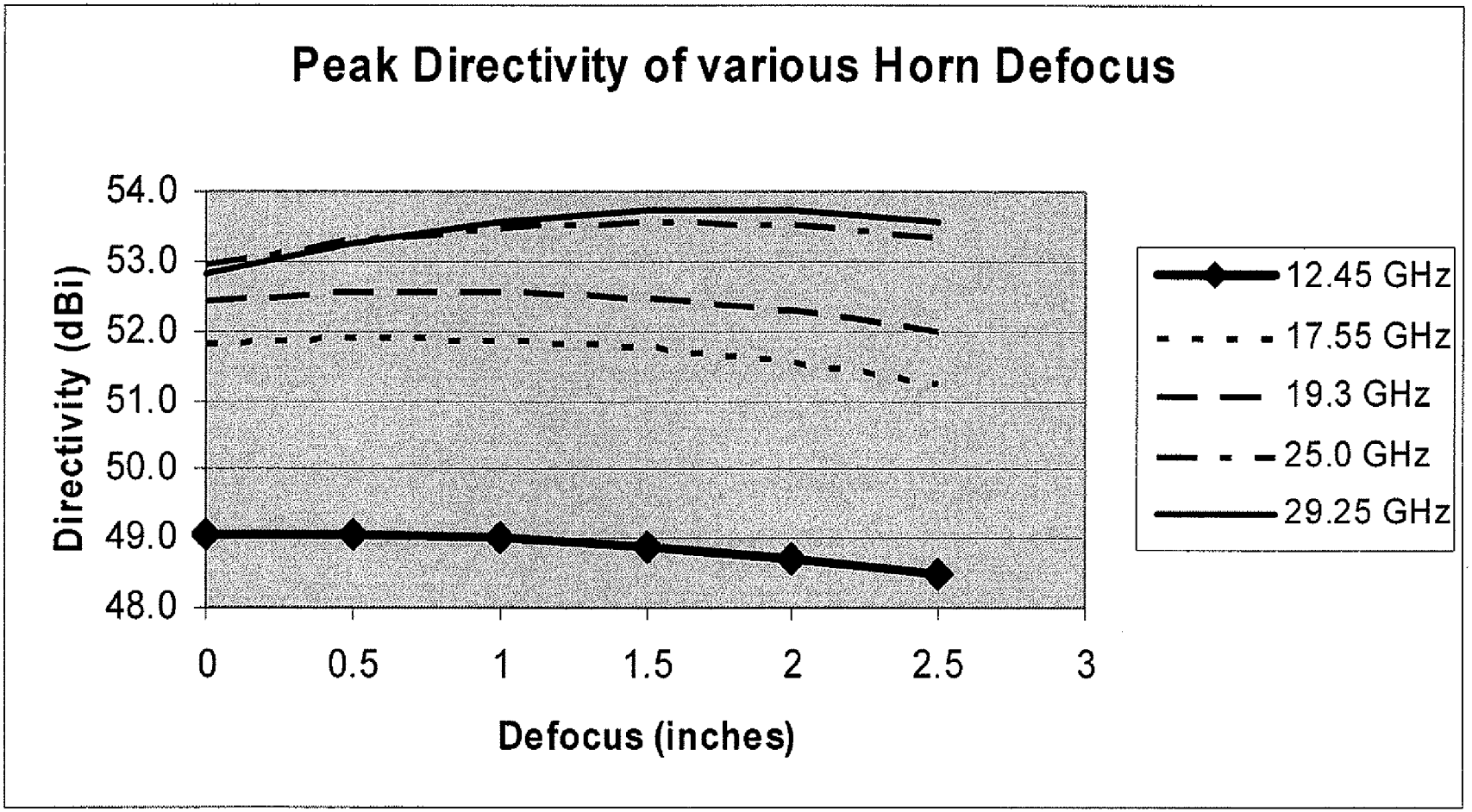
FIG. 19 is an exemplary graph of computed peak directivity plotted against different defocus values in accordance with exemplary embodiments of the present invention.

FIG. 19 is an exemplary graph of peak directivity plotted against different defocus values for five different frequencies in accordance with exemplary embodiments of the present invention.

Figure 20:
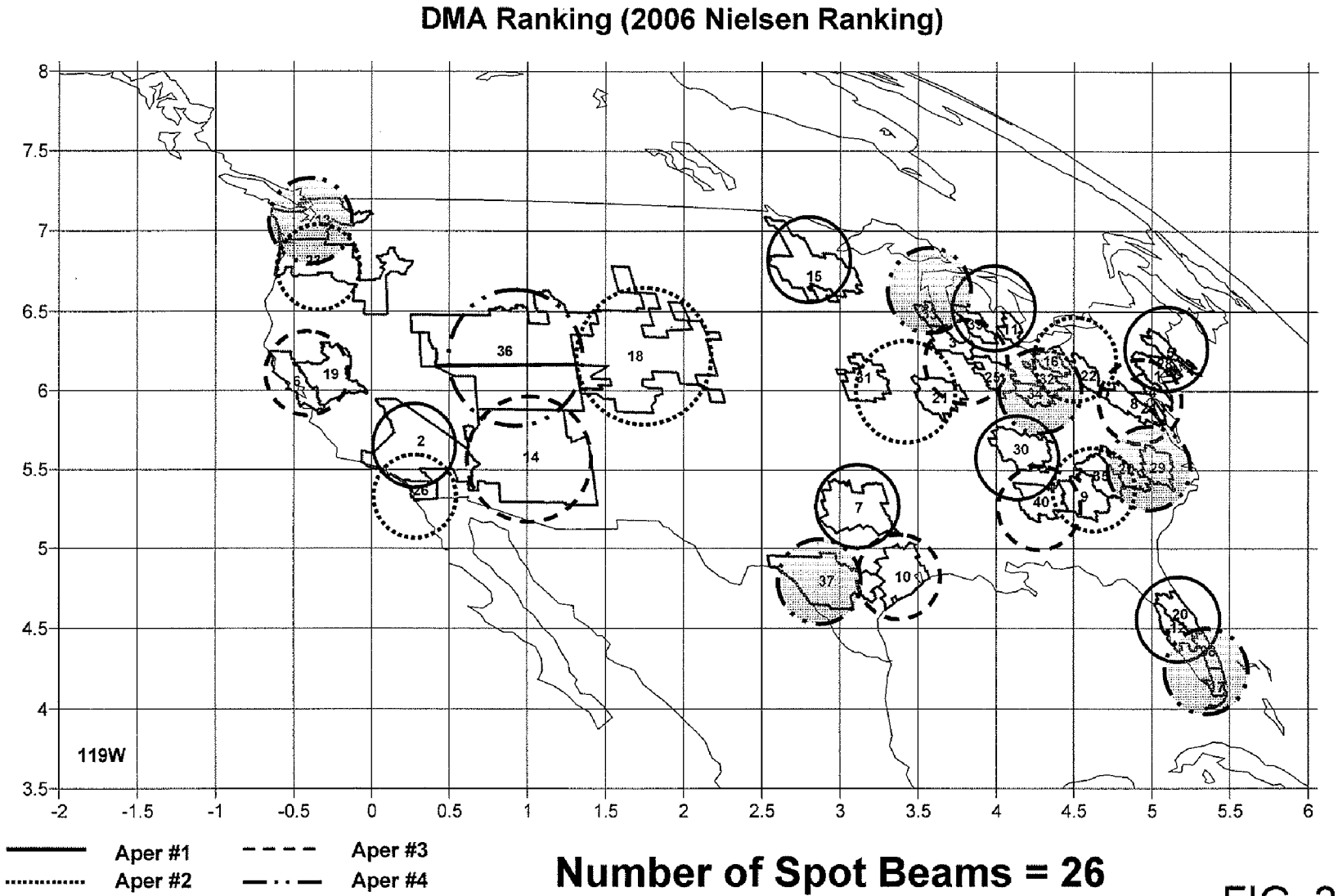
FIG. 20 illustrates an example showing continental United States (CONUS) coverage with DBS coverage for top 40 designated market areas (DMAs) and broadband service to top 60 major cities.
Figure 21:
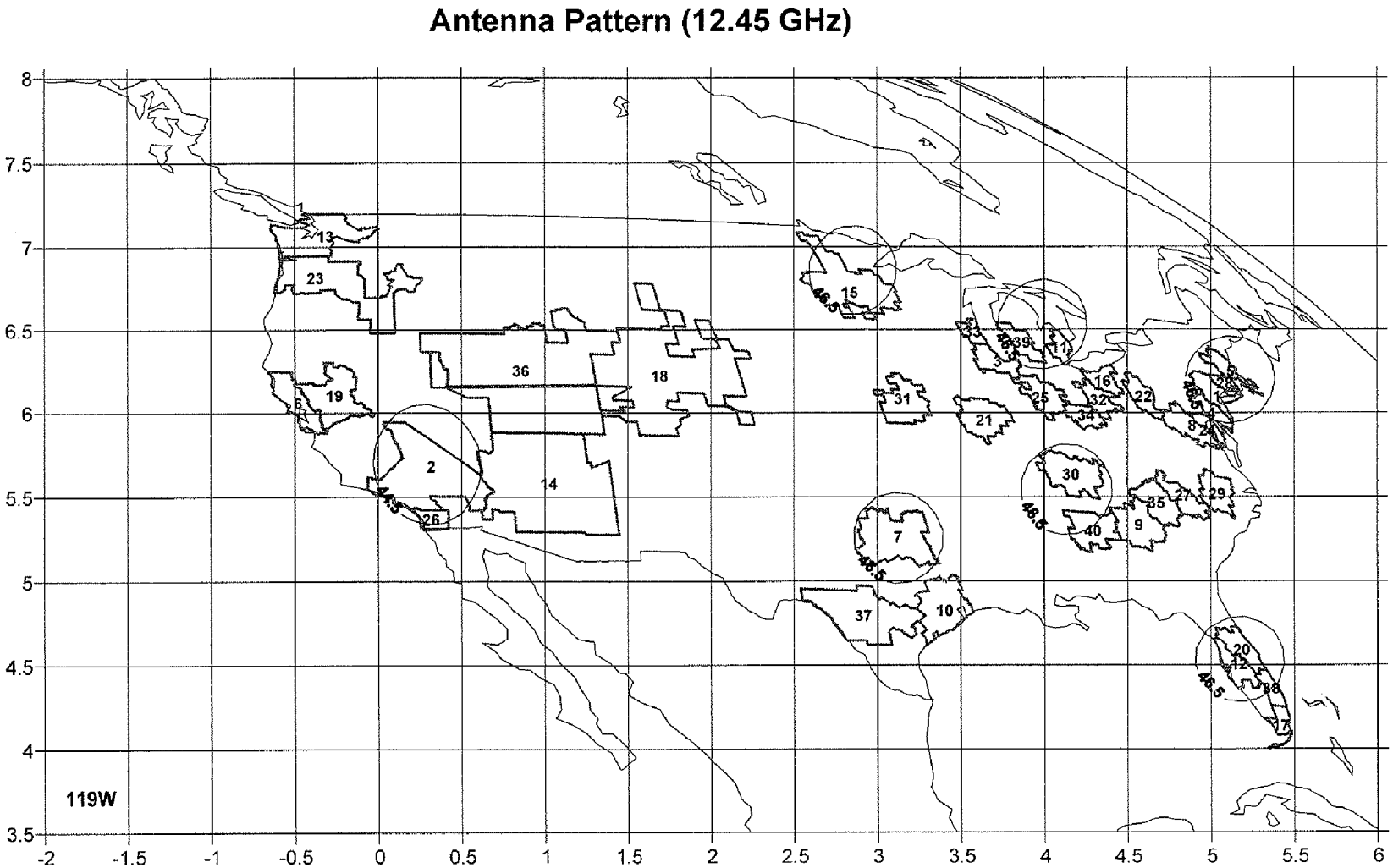
FIGS. 21, 22, 23, 24 and 25 illustrate computed antenna patterns for 12.45 GHz, 17.55 GHz, 19.3 GHz, 25.0 GHz, and 29.25 GHz, respectively.
Figure 22:
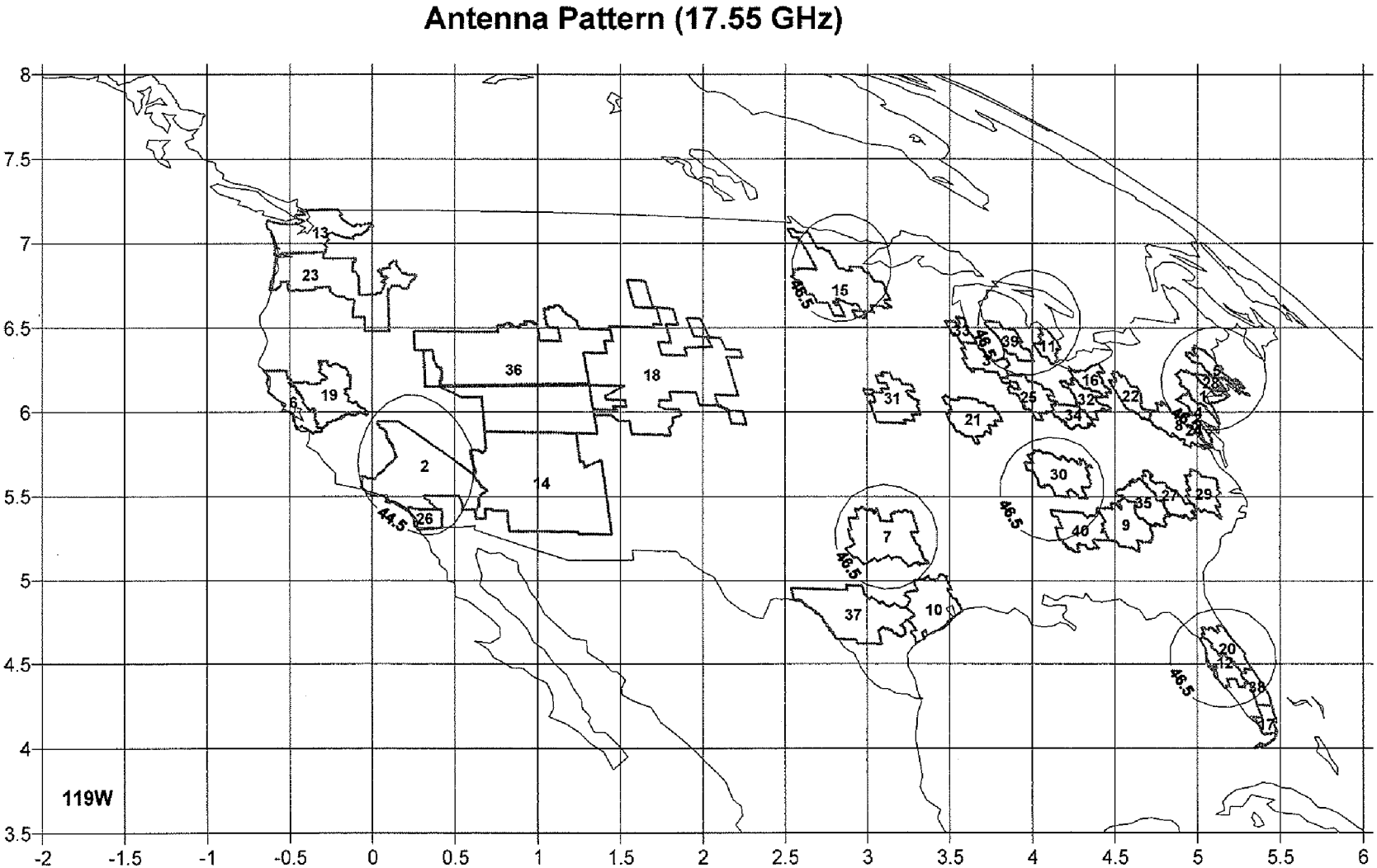
Figure 23:
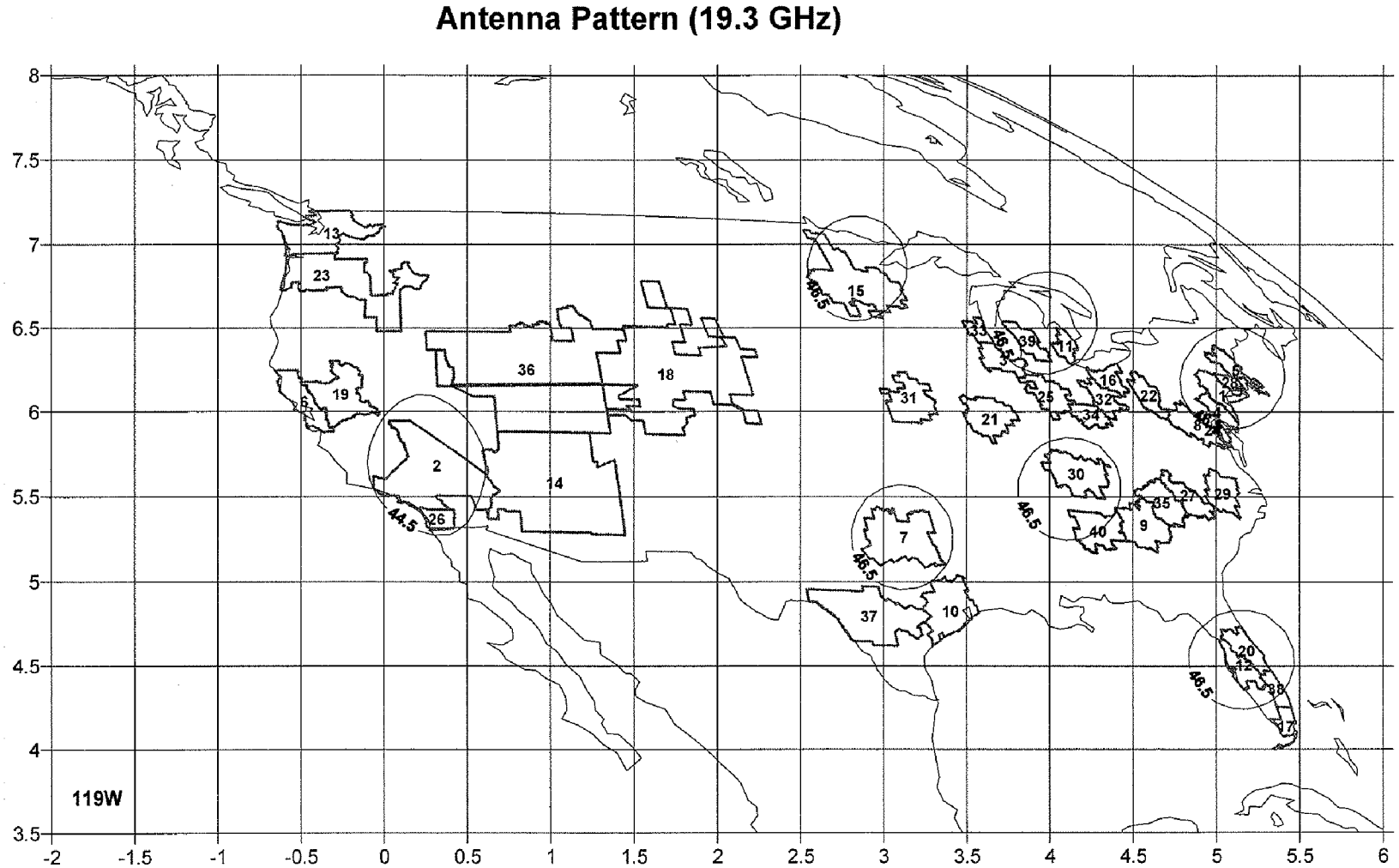
Figure 24:
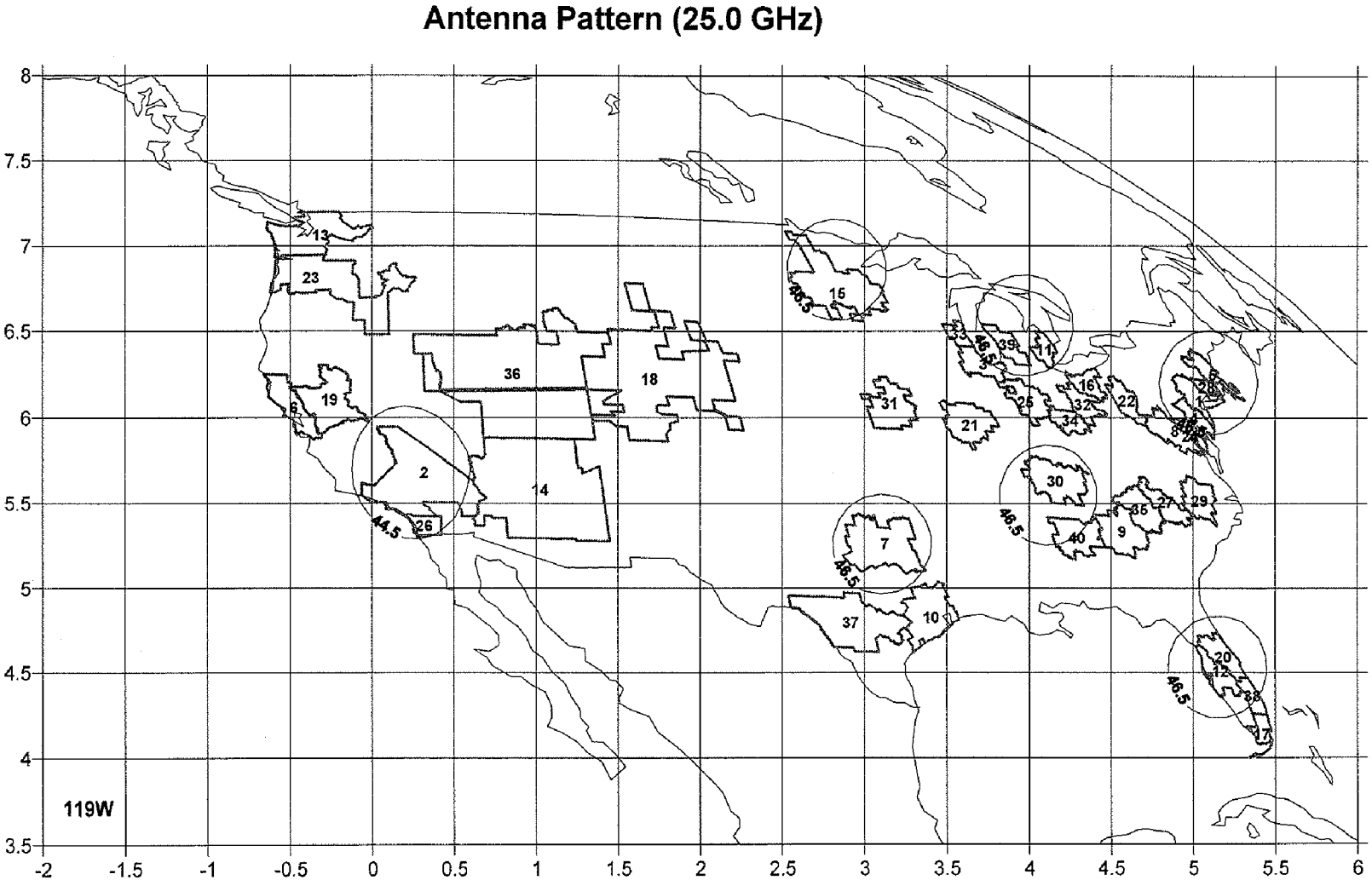
Figure 25:
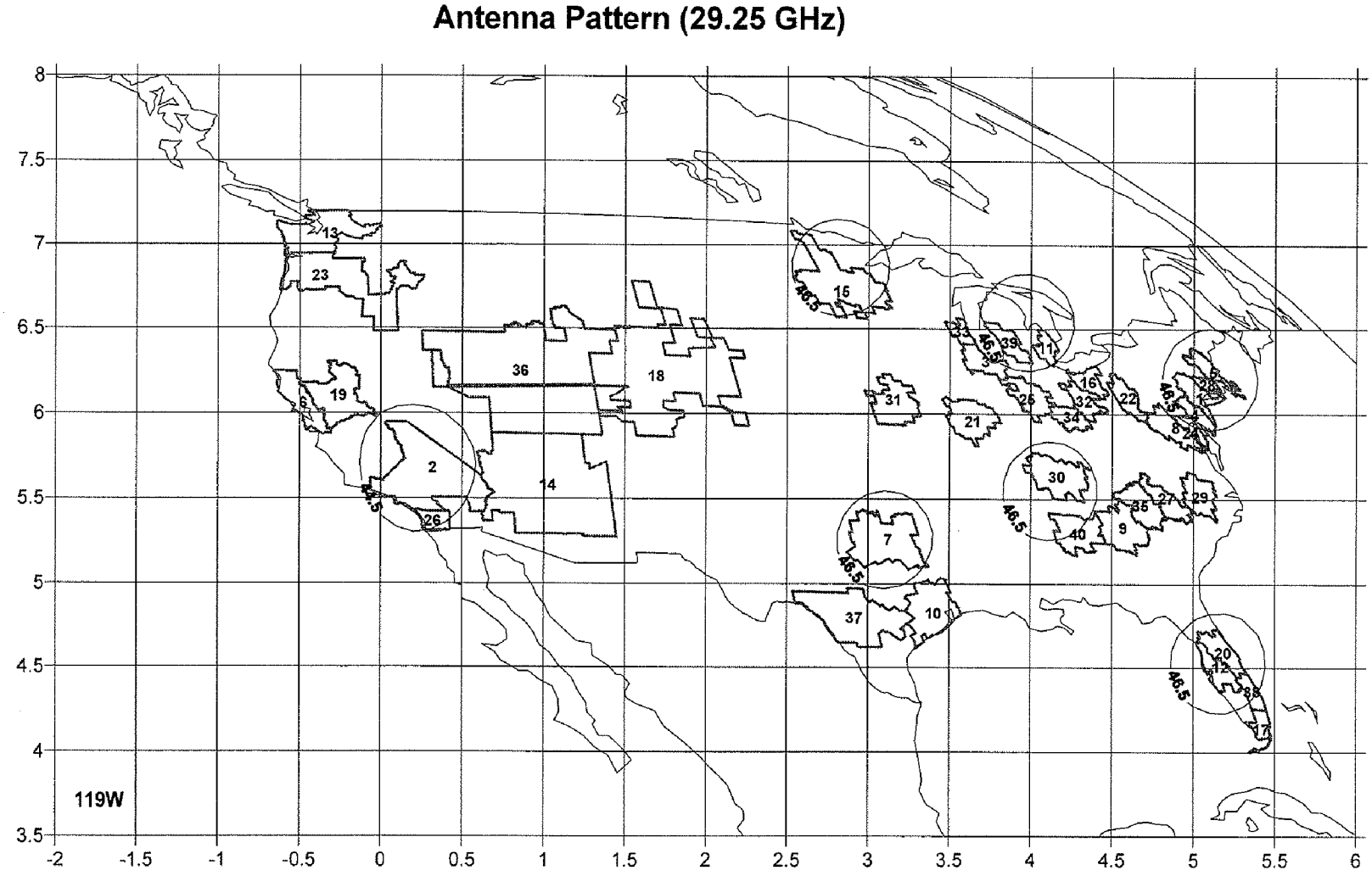

FIG. 20 illustrates an example showing continental United States (CONUS) DBS coverage for top 40 designated market areas (DMAs) and broadband service to top 60 major cities. A repeater may employ conventional payload equipment, except for the multi-band (e.g., quad-band) antenna for the three links (e.g., for DBS uplink and downlink, for broadband forward link (Gateway to satellite to user), and for reverse link (user to satellite to Gateway)). The multi-band antenna is also applicable to millions of ground terminals that need to carry identical frequency bands as the satellite, but with transmit and receive functions reversed relative to the satellite.

FIGS. 21, 22, 23, 24 and 25 illustrate exemplary computed antenna patterns for 12.45 GHz, 17.55 GHz, 19.3 GHz, 25.0 GHz, and 29.25 GHz, respectively. FIG. 26A illustrates an exemplary performance summary of a multi-band horn antenna for forward DBS in accordance with exemplary embodiments of the present invention. It illustrates an exemplary edge of coverage (EOC) directivity and the ratio between co-polarization and cross-polarization (C/X) for four frequencies. FIG. 26B illustrates an exemplary performance summary of a multi-band horn antenna for reverse DBS in accordance with exemplary embodiments of the present invention. It illustrates an exemplary edge of coverage directivity and the ratio between co-polarization and cross-polarization (C/X) for four frequencies.

Exemplary embodiments of the present invention include horn antennas configured to obtain high efficiency with higher order transverse electric (TE) modes, for instance, going beyond the dominant TE11 mode to TE12, TE13, TE14, and TE15 etc. modes.

In certain exemplary embodiments of the present invention, the minimum diameter of the aperture 1040 (or the minimum diameter of an interior surface 1040 of a horn antenna 230 of FIG. 10A) is that diameter necessary to support at least the first higher modes (TE12 & TE13) at the lowest frequency of the frequency bands intended to be transmitted or received, and therefore will be preferably no less than 1.7 times the wavelength of the lowest frequency of the multiple frequency bands.

In certain exemplary embodiments of the present invention, the maximum diameter of an aperture 1040 (or the maximum diameter of an interior surface 1020 of a horn antenna 230 of FIG. 10A) may be configured in view of the cross-polarizations of the highest frequency of the multiple frequency bands. Along these lines, in order to achieve a cross-polarization level of better than −15 dB, the maximum diameter of the interior surface of a horn antenna is preferably less than 12 times the wavelength of the highest frequency of the multiple frequency bands.

For the frequency bands of 12.2 GHz to 30.0 GHz, a minimum diameter may be 1.65 inches, and a maximum diameter may be 4.72 inches according to one embodiment of the present invention.

According to exemplary embodiments, a multi-band (e.g., quad-band) antennas and systems (e.g., a feed assembly) use high efficiency feed. A multi-band antenna has extremely wide bandwidth covering about 12 GHz to 30 GHz that supports conventional DBS, reverse DBS, and Ka-band broadband satellite services. One common antenna can support all three services and can utilize forward or reverse DBS, and broadband services simultaneously. A multi-band antenna has applications for future satellites as well as ground terminals.

According to certain aspects, the disclosed invention for the first time has realized an antenna system providing more than an octave bandwidth while maintaining highly efficient radiation at four distinct frequency bands at a given time, but could support five bands. In one exemplary embodiment, this is achieved by using an efficient multi-band (e.g., quad-band) horn antenna that supports four distinct frequency bands that are widely separated and that combines both DBS and Ka-band broadband satellite services into one common antenna system. The advantages are, for example: (a) a single satellite can provide both services instead of two satellites, (b) the number of reflectors is reduced by a factor of two, (c) the number of horn antennas and feed networks is reduced by a factor of two, (d) the subject technology provides a significant reduction in the ground support equipment in terms of, for example, the number of gateways and the number of user terminals, (e) the subject technology can support both forward DBS and the reverse DBS services using one common antenna system. Furthermore, the operators can now provide conventional DBS/reverse DBS, and Ka-band broadband satellite services to the users using a common ground terminal that provides TV and internet services, and (f) the subject technology has significant impact on commercial as well as military satellites.

It is understood that any specific order or hierarchy or steps in the processes disclosed herein are merely exemplary illustrations and approaches. Based upon design preferences, it is understood that any specific order or hierarchy of steps in the process may be re-arranged. Some of the steps may be performed simultaneously.

The previous description is provided to enable persons of ordinary skill in the art to practice the various aspects described herein. Various modifications to these aspects will be readily apparent to those skilled in the art, and the general principles defined herein may be applied to other aspects. Thus, the claims are not intended to be limited to the aspects shown herein, but are to be accorded the full scope consistent with the claim language. Headings and subheadings, if any, are used for convenience only and do not limit the invention. All structural and functional equivalents to the elements of the various aspects described throughout the disclosure that are known or later come to be known to those of ordinary skill in the art are expressly incorporated herein by reference and are intended to be encompassed by the invention. Moreover, nothing disclosed herein is intended to be dedicated to the public regardless of whether such disclosure is explicitly recited in the above description.

As used herein, a reference to an element in the singular is not intended to mean "one and only one" unless specifically stated, but rather "one or more." The term "selected" may refer to predetermined or pre-selected. The term "some" refers to one or more. Underlined and/or italicized headings and subheadings are used for convenience only, do not limit the invention, and are not referred to in connection with the interpretation of the description of the invention. All structural and functional equivalents to the elements of the various embodiments of the invention described throughout this disclosure that are known or later come to be known to those of ordinary skill in the art are expressly incorporated herein by reference and intended to be encompassed by the invention. Moreover, nothing disclosed herein is intended to be dedicated to the public regardless of whether such disclosure is explicitly recited in the above description.

What is claimed is:

1. An antenna system for transmitting and/or receiving radio frequency signals in multiple frequency bands, the antenna system comprising:

a horn antenna configured to transmit and/or receive radio frequency signals in multiple frequency bands that are spread over more than an octave bandwidth with at least a 2.44-to-1 bandwidth ratio, the horn antenna comprising:

a throat disposed at a first end of the horn antenna;

an aperture disposed distantly from the throat at a second end of the horn antenna; and an interior surface disposed in the horn antenna between the first end and the second end of the horn antenna, the interior surface comprising a plurality of slope discontinuities; and a feed network coupled to the horn antenna, the feed network comprising:

a first waveguide section configured to provide a matching network, the first waveguide section configured to transmit and/or receive the radio frequency signals in the multiple frequency bands;

a first junction configured to transmit and/or receive the radio frequency signals in first selected one or more frequency bands of the multiple frequency bands and not all of the multiple frequency bands;

one or more first filters configured to pass the radio frequency signals in the first selected one or more frequency bands of the multiple frequency bands and configured to reject the radio frequency signals in frequency bands not in the first selected one or more frequency bands of the multiple frequency bands; and a first step-down waveguide section coupled to the first waveguide section, the first step-down waveguide section configured to transmit and/or receive the radio frequency signals in second selected one or more frequency bands of the multiple frequency bands and configured to reject the radio frequency signals in the first selected one or more frequency bands of the multiple frequency bands.

2. The antenna system of claim 1, wherein the multiple frequency bands occupy a frequency range from at least about 12.2 GHz to at least about 30 GHz.

3. The antenna system of claim 1, wherein the first junction is symmetrical, and the first junction comprises a plurality of waveguide slots configured to transmit and/or receive the radio frequency signals in the first selected one or more frequency bands of the multiple frequency bands and not all of the multiple frequency bands.

4. The antenna system of claim 1, further comprising:

a second junction comprising a plurality of waveguide slots configured to transmit and/or receive the radio frequency signals in third selected one or more frequency bands of the multiple frequency bands, the third selected one or more frequency bands not including the first selected one or more frequency bands and being a subset of the second selected one or more frequency bands; and a second set of filters configured to pass the radio frequency signals in the third selected one or more frequency bands of the multiple frequency bands and configured to reject the radio frequency signals in the fourth selected one or more frequency bands of the multiple frequency bands.

5. The antenna system of claim 4, further comprising:

a plurality of vertical plane waveguide bend sections coupled to the second set of filters;

a plurality of horizontal plane waveguide bend sections coupled to the second set of filters;

a vertical plane junction coupled to the plurality of vertical plane waveguide bend sections and configured to divide radio frequency signals into vertical plane radio frequency signals for transmission and to combine vertical plane radio frequency signals into radio frequency signals for reception;

a horizontal plane junction coupled to the plurality of horizontal plane waveguide bend sections and configured to divide radio frequency signals into horizontal plane radio frequency signals for transmission and to combine horizontal plane radio frequency signals into radio frequency signals for reception; and a coupler/polarizer configured to combine or divide radio frequency signals and to polarize radio frequency signals from one form to another form.

6. The antenna system of claim 5, further comprising:

a plurality of multiplexers coupled to the coupler/polarizer to separate RF signals into two or more discrete frequency bands.

7. The antenna system of claim 4, further comprising:

a second step-down waveguide section configured to transmit and/or receive the radio frequency signals in the fourth selected one or more frequency bands of the multiple frequency bands and configured to reject the radio frequency signals in the third selected one or more frequency bands of the multiple frequency bands.

8. The antenna system of claim 7, further comprising:

a polarizer and a transition section coupled to the second step-down waveguide section for dual-circular polarization operation.

9. The antenna system of claim 1, wherein the horn antenna comprises an axis extending lengthwise between the first end and the second end, the interior surface beyond the throat comprises linear slopes that are greater than zero and less than ninety degrees with respect to the axis, the interior surface beyond the throat lacks any surface having a ninety degree slope with respect to the axis, and the interior surface beyond the throat lacks curved surfaces, and wherein the horn antenna is configured to support a dominant mode of a transverse electric (TE) mode electromagnetic wave and one or more higher order modes of the TE mode and configured not to support any transverse magnetic (TM) modes.

10. The antenna system of claim 1, further comprising:

a single or multiple reflectors;

a plurality of horn antennas, wherein each of the single or multiple reflectors is configured to be illuminated by the horn antenna and/or the plurality of horn antennas to generate multiple beams at multiple frequency bands, and wherein the surface of each of the single or multiple reflectors is either parabolic or non-parabolic in shape to support multiple frequency bands; and a repeater comprising:

one or more receivers configured to receive the radio frequency signals in one or more receive frequency bands of the multiple frequency bands;

one or more filters configured to filter the radio frequency signals and pass the radio frequency signals in one or more transmit frequency bands of the multiple frequency bands;

one or more linearized traveling wave tube amplifiers configured to amplify the radio frequency signals received from the one or more filters; and one or more output filters configured to filter the radio frequency signals received from the one or more linearized traveling wave tube amplifiers.

11. An antenna system for transmitting and/or receiving radio frequency signals in multiple frequency bands, the antenna system comprising:

a horn antenna configured to transmit and/or receive radio frequency signals in multiple frequency bands, the horn antenna comprising:

a throat disposed at a first end of the horn antenna;

an aperture disposed distantly from the throat at a second end of the horn antenna; and an interior surface disposed in the horn antenna between the first end and the second end of the horn antenna, the interior surface comprising a plurality of slope discontinuities, the interior surface increasing in diameter from the first end of the horn antenna to the second end of the horn antenna, the interior surface having the smallest diameter at the throat, the interior surface having the largest diameter at the aperture, the diameter of the interior surface at the aperture being less than 12 times the wavelength of the highest frequency of the multiple frequency bands, the diameter of the interior surface at the aperture being greater than 1.7 times the wavelength of the lowest frequency of the multiple frequency bands;

a feed network coupled to the horn antenna, the feed network comprising:

a first waveguide section configured to provide a matching network, the first waveguide section configured to transmit and/or receive the radio frequency signals in the multiple frequency bands;

a first junction configured to transmit and/or receive the radio frequency signals in first selected one or more frequency bands of the multiple frequency bands and not all of the multiple frequency bands;

one or more first filters configured to pass the radio frequency signals in the first selected one or more frequency bands of the multiple frequency bands and configured to reject the radio frequency signals in frequency bands not within the first selected one or more frequency bands of the multiple frequency bands; and a first step-down waveguide section configured to transmit and/or receive the radio frequency signals in second selected one or more frequency bands of the multiple frequency bands and not in the first selected one or more frequency bands of the multiple frequency bands.

12. The antenna system of claim 11, wherein the first junction is symmetrical, and the first junction comprises a plurality of waveguide slots configured to transmit and/or receive the radio frequency signals in the first selected one or more frequency bands of the multiple frequency bands and not all of the multiple frequency bands.

13. The antenna system of claim 11, further comprising:

a second junction comprising a plurality of waveguide slots configured to transmit and/or receive the radio frequency signals in third selected one or more frequency bands of the multiple frequency bands, the third selected one or more frequency bands not including the first selected one or more frequency bands and being a subset of the second selected one or more frequency bands; and one or more second filters configured to pass the radio frequency signals in the third selected one or more frequency bands of the multiple frequency bands and configured to reject the radio frequency signals in fourth selected one or more frequency bands of the multiple frequency bands.

14. The antenna system of claim 13, further comprising:

a plurality of vertical plane waveguide bend sections coupled to the one or more second filters;

a plurality of horizontal plane waveguide bend sections coupled to the one or more second filters;

a vertical plane junction coupled to the plurality of vertical plane waveguide bend sections and configured to divide radio frequency signals into vertical plane radio frequency signals for transmission and to combine vertical plane radio frequency signals into radio frequency signals for reception;

a horizontal plane junction coupled to the plurality of horizontal plane waveguide bend sections and configured to divide radio frequency signals into horizontal plane radio frequency signals for transmission and to combine horizontal plane radio frequency signals into radio frequency signals for reception; and a coupler and a polarizer configured to combine or divide radio frequency signals and to polarize radio frequency signals from one form to another form.

15. The antenna system of claim 14, further comprising:

a plurality of multiplexers coupled to the coupler and the polarizer.

16. The antenna system of claim 13, further comprising:

a second step-down waveguide section configured to transmit and/or receive the radio frequency signals in the fourth selected one or more frequency bands of the multiple frequency bands and configured to reject the radio frequency signals in the third selected one or more frequency bands of the multiple frequency bands.

17. The antenna system of claim 16, further comprising:

a polarizer and a transition section coupled to the second step-down waveguide section.

18. The antenna system of claim 11, wherein the multiple frequency bands occupy a frequency range from at least about 12.2 GHz to at least about 30 GHz.

19. The antenna system of claim 11, wherein the horn antenna comprises an axis extending lengthwise between the first end and the second end, the interior surface beyond the throat comprises linear slopes that are greater than zero and less than ninety degrees in angle with respect to the axis, the interior surface beyond the throat lacks any surface having a zero degree slope with respect to the axis, and the interior surface beyond the throat lacks any surface having a ninety-degree slope with respect to the axis, and wherein the horn antenna is configured to support a dominant mode of a transverse electric (TE) mode of electromagnetic wave and one or more higher order modes of the TE mode and configured not to support any transverse magnetic (TM) modes.

20. The antenna system of claim 11, further comprising:

at least one reflector;

a plurality of horn antennas, the horn antenna and the plurality of horn antennas forming a cluster to feed the at least one reflector; and a repeater comprising:

one or more receivers configured to receive the radio frequency signals in one or more receive frequency bands of the multiple frequency bands;

one or more filters configured to filter the radio frequency signals and pass the radio frequency signals in one or more transmit frequency bands of the multiple frequency bands;

one or more linearized traveling wave tube amplifiers configured to amplify the radio frequency signals received from the one or more filters; and one or more output filters configured to filter the radio frequency signals received from the one or more linearized traveling wave tube amplifiers.

21. The antenna system of claim 20, wherein the horn antenna and/or the plurality of horn antennas are configured to be defocused relative to a focal-plane of the at least one reflector to optimize radio frequency (RF) performance over multiple frequency bands.

* * * * *